United States Patent [19]

Tsutsumi et al.

[11] Patent Number: 4,473,989

[45] Date of Patent: Oct. 2, 1984

[54] METHOD, A LINE AND A POUCH SUPPORTING BASE FOR AUTOMATICALLY FILLING UP AND SEALING POUCHES AT HIGH SPEED

[75] Inventors: Yotaro Tsutsumi; Noboru Wakayama, both of Yokohama, Japan

[73] Assignee: Toyo Seikan Kaisha, Ltd., Tokyo, Japan

[21] Appl. No.: 311,710

[22] Filed: Oct. 15, 1981

[30] Foreign Application Priority Data

| | | | |
|---|---|---|---|
| Oct. 17, 1980 | [JP] | Japan | 55-144474 |
| Jun. 2, 1981 | [JP] | Japan | 56-83777 |
| Jun. 24, 1981 | [JP] | Japan | 56-92267[U] |

[51] Int. Cl.[3] ..... B65B 43/30; B65B 3/04

[52] U.S. Cl. ..... 53/459; 53/571; 53/266 R; 141/166; 198/472

[58] Field of Search ..... 53/458, 459, 455, 570, 53/571, 562, 266 R, 373; 141/166, 165, 10, 369, 114, 313–317; 198/472, 447, 648

[56] References Cited

U.S. PATENT DOCUMENTS

| | | | |
|---|---|---|---|
| 2,722,358 | 11/1955 | Wilson | 53/571 X |
| 2,768,655 | 10/1956 | Bergeron | 141/166 X |
| 2,865,158 | 12/1958 | Wakeman | 198/478 X |
| 3,052,269 | 9/1962 | Manas | 141/166 X |
| 3,352,405 | 11/1967 | Gartin et al. | 198/478 |
| 3,369,577 | 2/1968 | Johnson et al. | 141/166 X |
| 3,406,727 | 10/1968 | Rexus | 141/166 X |
| 3,728,840 | 4/1973 | Izumi | 53/570 X |
| 3,955,334 | 5/1976 | Wild et al. | 53/571 X |
| 4,318,431 | 3/1982 | Evans | 141/166 X |
| 4,423,583 | 1/1984 | Carey | 53/570 X |

FOREIGN PATENT DOCUMENTS

| | | | |
|---|---|---|---|
| 1057694 | 3/1954 | France | 53/571 |
| 341214 | of 1972 | U.S.S.R. | 53/571 |

*Primary Examiner*—Horace M. Culver

*Attorney, Agent, or Firm*—Jordan and Hamburg

[57] ABSTRACT

In automatically filling and sealing pouches at high speed a pouch supporting base continuously and non-stoppably travels on a conveying path passing a pouch dropping operation station, a filling up operation station, a sealing operation station and a supporting base collecting station in turn. In the pouch dropping operation station, pouches are dropped into the pouch supporting base after being opened one by one. In the filling up operation station, a fixed amount of substances fills the pouches through the rotary filling up apparatus from the opened filling up mouth of the pouches held by the pouch supporting base. In the sealing operation station the filling up mouth of the pouches is hermetically sealed by the sealing operation system apparatus. In the pouch supporting base collecting station, filled up pouches held by the pouch supporting base are suspended and conveyed, and the empty pouch supporting bases are collected and returned to the pouch dropping operation station.

47 Claims, 23 Drawing Figures

METHOD, A LINE AND A POUCH SUPPORTING BASE FOR AUTOMATICALLY FILLING UP AND SEALING POUCHES AT HIGH SPEED

This invention relates generally to packing pouches of paper, plastic, aluminum foil, etc. or a combination thereof and more particularly to a method and a line for automatically sealing packing pouches at high speed, which performs a series of operations, with an entirely automatic and consistent system, comprising opening standing pouches which stand and keep shape for themselves, the pouches one by one into a pouch supporting base which holds the pouches upright, filling up with a substance from an upper filling up mouth, sealing the mouth, and separating the pouches from the pouch supporting base.

In packing pouches such as unstable and ill-shaped three-sides-sealed flat pouches, gusset pouches, and standing pouches, it is impossible to automatically perform a series of operations of opening the upper filling up mouth, filling up various kinds of foods in the pouches and finally sealing the mouth, without any holding means. Therefore, the conventional filling up sealing apparatus incorporates such a holding means at each operating station, operating speed is influenced by the lowest speed operating resulting in low working efficiency. Further, since the applicable size of the operating objects or the packing pouches is fixed, it is impossible to apply the apparatus to different sizes. If some sizes are applied, it is necessary to improve the apparatus. Thus, lack of adaptability and flexibility prevents the conventional apparatus from meeting the needs of increased demand and variety of sizes in accordance with many kinds of foods.

With great improvement of the above defects, the inventors of this application already provided a method and a line for automatically opening, filling up and sealing plastic pouches, this being described in Japanese Patent Publication No. 56-285. In the above improved apparatus, by independently separating the holding means for packing pouches from the handling device, there can be achieved entirely automatic and throughout-systematic handling and line performs a series of operations of holding the packing pouches upright, opening the filling up mouth, filling up substances into the pouches and hermetically sealing the filling up mouth, with great improvement of handling capability and speed, a large scale of work and liberalization of design. However, the use of a holder stand vertically hanging and sandwiching both seam ends of the unstable and ill-shaped plastic packing pouch results in an intermitten conveying condition of the holder stand. Therefore it goes without saying that filling up cans or bottles at high speed is impossible but, at most, 120 pouches is possible.

A rotary high speed liquid filling up machine, such as a filling up machine which continuously filling up liquid substances in each pouch at high speed, is generally used. However the normal object of the rotary high speed liquid filling up machine is to fill up a hard container such as a can or a bottle. With the open condition in which a filling up nozzle mechanism is lifted by pressing an upper filling up mouth portion of the hard container lifted by a lift mechanism to a nozzle hole of the filling up nozzle mechanism, a fixed amount of liquid substances are filled up in the hard container from the nozzle hole. After that, with the closing of the nozzle hole, whose upper filling up mouth portion is pressed, and the filling up nozzle mechanism moves down together with the hard container which is lowered by the action of a lift mechanism. Where both the conventional pouch supporting base holding the pouches upright with the upper filling up mouth of the pouches opened and the pouches are applied to said rotary high speed liquid filling up machine, it is impossible to apply the conventional method described above to soft material containers of which the upper portion is not supported to hermetically seal the upper filling up mouth and to remove the pouches from the pouch supporting base in the latter process. This is because the pouches would yield in conventional method. This is a great problem when working effeciency and speed is to be increased.

The primary object of this invention is to provide a method, a line and a pouch supporting base for automatically filling up and sealing pouches at high speed to raise the handling effeciency in accordance with speed-up of the filling up operation.

Other object of this invention is to provide a method, a line and a pouch supporting base for automatically filling up and sealing pouches at high speed to persuit rationalization, effectualization, mechanization, unmanned operation, reduction of labor and economization.

Another object of this invention is to provide a method and a line for automatically filling up and sealing pouches at high speed in which pouches are entered into the pouch supporting base after being opened, held upright by the pouch supporting base, hermetically sealed after filling up substances from the opened upper filling up mouth and finally separated from the pouch supporting base, which series of operations is performed with an entirely automatic and consistent system.

A further object of this invention is to provide a method and a line for automatically filling up and sealing pouches at high speed in which movement of the pouch supporting base is a continuous and non-stop conveyance as that of filling up cans or bottles during a consistent filling up system operation.

A further object of this invention is to provide a method, a line and a pouch supporting base for automatically filling up and sealing pouches at high speed in which the apparatus portions of the filling up and the sealing devices are possibly separated from the mechanism for the open-close and the hold-discharge of pouches.

A further object of this invention is to provide a method and a line for automatically filling up and sealing pouches at high speed which employs a pouch supporting base holding standing pouches upright and stable and keeping them well-shaped.

A further object of this invention is to provide a method and a line for automatically filling up and sealing pouches at high speed in which the pouch supporting base is used in endless circulation through the consistent filling up system operation.

A still further object of this invention is to provide a method, a line and a pouch supporting base for automatically filling up and sealing pouches at high speed in which an independent apparatus and an independent implement are combined to perform both the filling up and the sealing operation in spacedly separated condition.

A still further object of this invention is to provide a method, a line and a pouch supporting base for automatically filling up and sealing pouches at high speed in which at least 240 pouches or over are handled per minute through the whole lines.

A still further object of this invention is to provide a method and a line for automatically filling up and sealing pouches at high speed in which the rotary filling up device includes an exchanged tip of the filling up nozzle mechanism for pouches instead of a tip of the filling up nozzle mechanism equipped with a conventional rotary filling up device for cans or bottles.

A still further object of this invention is to provide a pouch supporting base which stably holds pouches as bottle or can containers are done during the filling up and sealing operation.

A still further object of this invention is to provide a pouch supporting base possible to be applied to a rotary high speed liquid filling up apparatus in soft containers such as pouches of plastic, aluminum foil, etc. or combination of them which are softer than hard containers of metal, glass, and so on.

A still further object of this invention is to provide a pouch supporting base which is always possible to set a filling up nozzle at the center of the opening mouth of the held pouches.

A still further object of this invention is to provide a pouch supporting base which has a mechanism forceably arranging held pouches in the fixed direction during conveyance.

The above and other advantages of the invention will become more apparent in the following description and the accompanying drawings in which.

In a method and a line for automatically filling up and sealing pouches at high speed in accordance with this invention, a pouch supporting base continuously and nonstoppably travels on a conveyance arrangement, passing a pouch dropping operation station, a filling up operation station, a sealing operation station and a supporting base collecting station, in turn. In the pouch dropping operation station, pouches are dropped into the pouch supporting base after being opened one by one and held by the pouch supplying and dropping operation system device. In the filling up operation station, a fixed amount of substances is filled up through the rotary filling up apparatus from the opened filling up mouth of pouches held by the pouch supporting base. In the sealing operation station, the filling up mouth of pouches is hermetically sealed by the sealing operation system apparatus. In the pouch supporting base collecting station, filled up pouches held by the pouch supporting base are suspended and conveyed, and the empty pouch supporting bases are collected and then returned to the pouch dropping operation station. Automatic high speed mechanization is brought about by the above circle.

Many pouch supporting bases (A1) may be used in accordance with the first embodiment of this invention.

Figure 1:
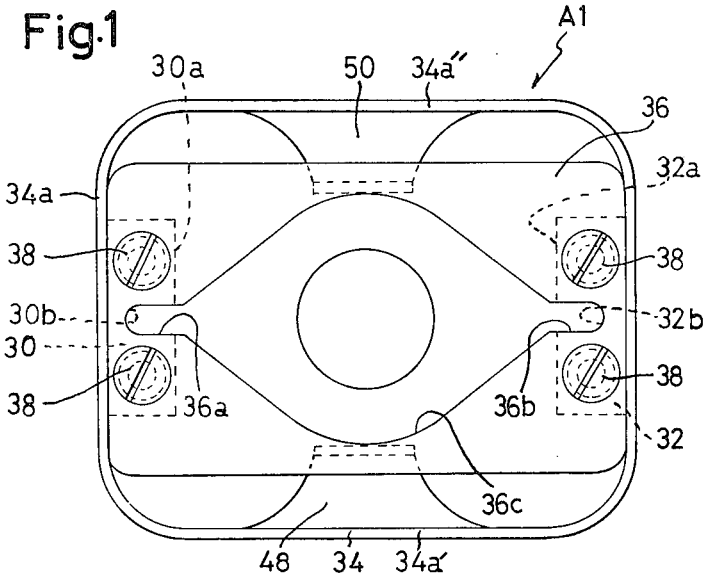
FIGS. 1 and 2 are respectively a plan view and a side view of a pouch supporting base showing a first embodiment constructed in accordance with this invention.
Figure 2:
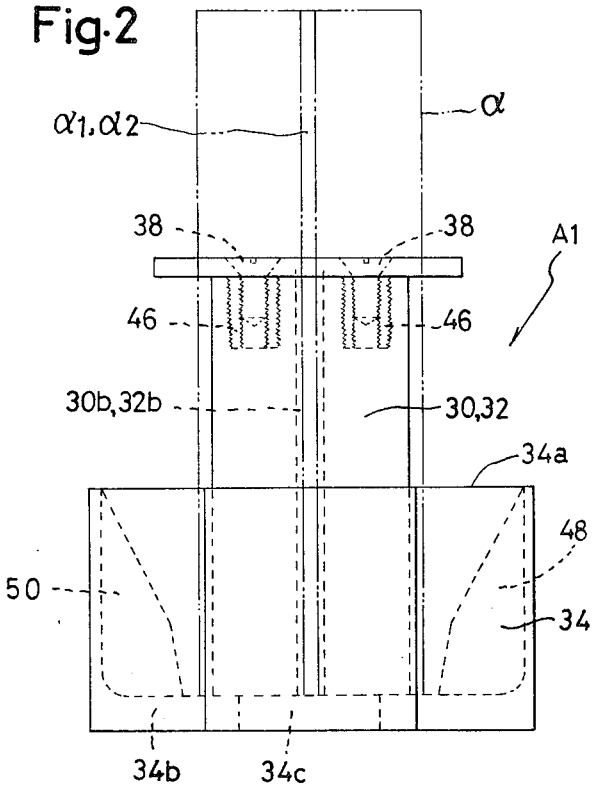

As shown in FIGS. 1 and 2, a pouch supporting base (A1) has a pair of right and left pouch holding pillars (30)(32), which stand opposite in the right and left position within a base box (34), including opposite faces (30*a*)(32*a*) having lengthwise insert grooves (30*b*)(32*b*) holding both end seam edges ($\alpha$1)($\alpha$2) of a stable and well-shaped pouch ($\alpha$) opened and expanded. Over the top ends of the right and left pouch holding pillars (30)(32) there is screwed a push-up plate (36) having a holding hole (36*c*) in conformity with the outline of the transverse section of the expanded pouch ($\alpha$) and having right and left side groove portions (36*a*)(36*b*) meshing with the insert grooves (30*b*)(32*b*).

The push-up plate (36) is formed of a size to freely contact a lower opening edge (44*a*) including a elastic body (44) of a filling up nozzle cover (42) being attached to a lower end of a filling up nozzle mechanism (40) of the rotary high speed liquid filling machine (E) and having a funnel-shaped nozzle opening (42*a*) which is hung from the middle of the top and on which the upper end filling mouth ($\alpha$3) of the pouch ($\alpha$) is inlaid on the outside. The right and left ends of the push-up plate (36) are screwed on the upper ends of the right and left pouch holding pillars (30)(32) with male screws (38) sunk into female thread portions (46) buried under the top portions of the right and left pouch holding pillars (30)(32) and with the heads of the male screws not projected from the upper surface of the push-up plate (36).

In the base box (34), as described above, the right and left pouch holding pillars (30)(32) stand opposite, and guiding project portions (48)(50) are formed in the front and rear wall portions (48)(50) of the circumferential wall (34*a*), where the right and left pouch holding pillars (30)(32) do not exist, to reinforce the front and rear wall portions, to guide the lower part of the pouch ($\alpha$) and to prevent the filled up pouch ($\alpha$) from expanding over a given dimension. That is, to prevent the lower part of the filled up pouch ($\alpha$), which sometimes expands more than a given dimension by vibrations occurring during transmission of the pouches ($\alpha$), to the pouch supporting base collecting station (G) when the filled up sealed pouches ($\alpha$) are separated from the pouch supporting bases (A1), from being caught by the push-up plate (36) having the holding hole (36*c*), the guiding project portions (48)(50) are formed opposite to be internally lower-inclined from the top ends of the front and rear wall portion (34*a*')(34*a*'') with right and left side surfaces formed of convex arcuate shape. In the middle of a bottom plate portion (34*b*) ia provided a scupper (34*c*) for discharging substances, which tend to drip into the pouch supporting bases (A1).

Figure 3:
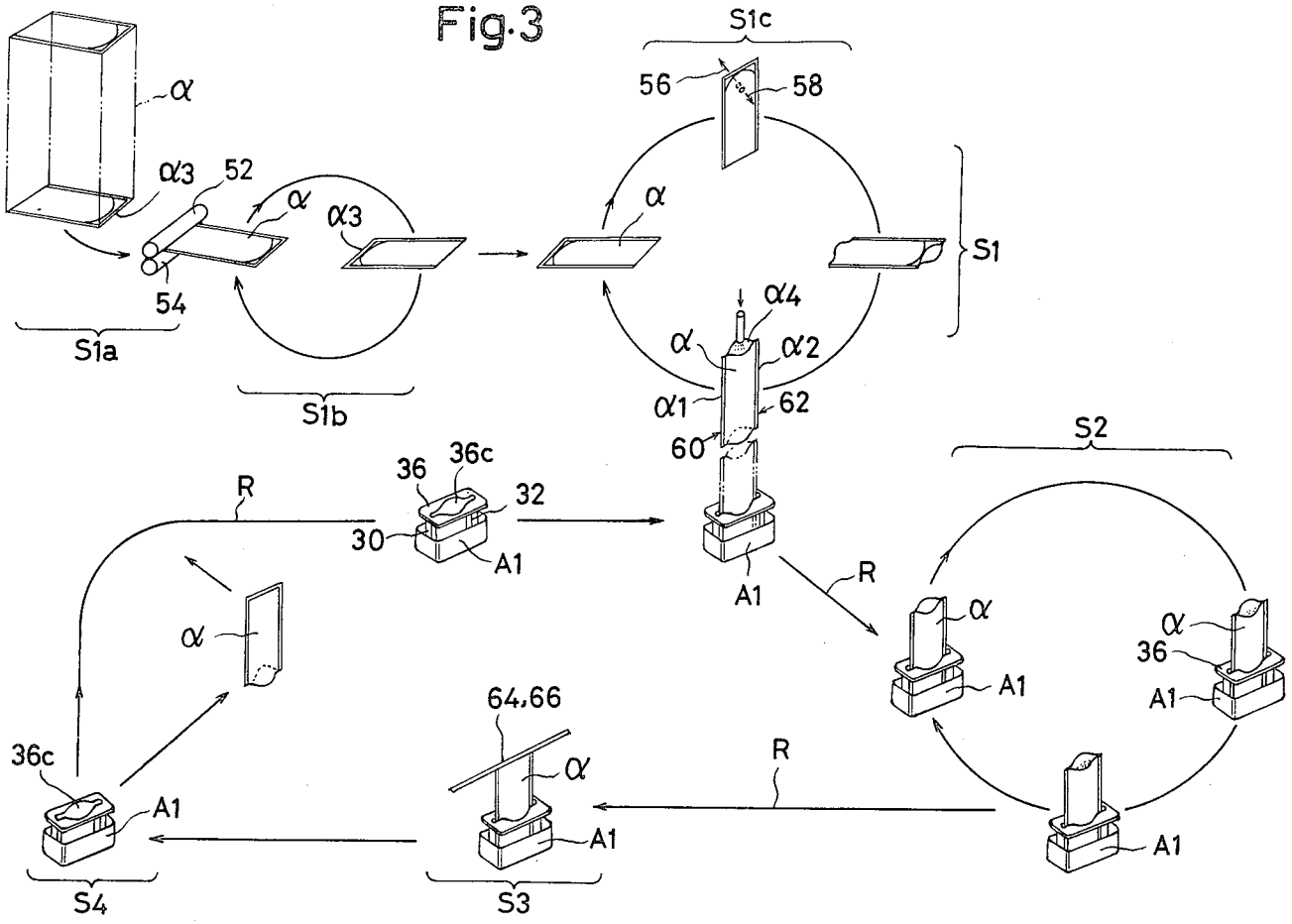
FIG. 3 is a flow diagram in accordance with this invention.

In the method of this invention, as shown in FIG. 3, the pouch supporting base (A1) moves on endless circular conveyance path (R) passing the pouch dropping operation station (S1), the filling up operation station (S2), the seal operation station (S3), and the pouch supporting base collecting operation station (S4). Both end seam edges (α1)(α2) of the pouch (α) held by the pouch supporting base (A1) are directed at a right angle to the moving direction in the pouch dropping operation station (S1) and in conformity with the moving direction in the filling up operation station (S2), the seal operation station (S3) and the pouch supporting base collecting operation station (S4). The travel is continuous and non-stop in accordance with the predetermined working operation steps.

The pouch dropping operation station (S1) includes a the preceding section (S1*a*), a middle section (S1*b*) and a latter section (S1*c*). In the preceding section (S1*a*), upper and lower draw-in rolls (52)(54) draw a bottom end (α3) of the lowest pouch (α) one by one from the piled flat pouches (α) shown in FIG. 4. In the middle section (S1*b*), the pouch (α) supplied by the upper and lower draw-in rolls (52)(54) is turned upside down, that is, the bottom end (α3) is delivered at the rear or trailing end. In the latter section (S1*c*), while the pouch (α) supplied by the middle section (S1*b*) is turned in a 270-degree arc, with the bottom up perpendicular position shifted from the horizontal position, both side faces are gripped and separated by vacuum cups (56)(58), and simultaneously with both end seam edges (α1)(α2) being opened by gradual pressure of grip pushers (60)(62), after gripping by the vacuum cups (56)(58) is unlocked and when the pouch (α) reaches the bottom up perpendicular position, blowing air into the opened filling up mouth (α4) produces an expansion of the pouch (α) and then the pouch (α) is dropped perpendicularly.

First the opened pouch (α) is dropped from above into the holding hole (36*c*) of the pouch supporting base (A1) at the time the pouch supporting base (A1) passes the fixed position under the latter section (S1*c*) in the pouch dropping operation station during a cycle of the pouch supporting base (A1) travel during conveyance, and then held upright, the second operation is that in which the fixed amount of substances is filled up into the pouch (α) as soon as the push-up plate (36) of the pouch supporting base (A1) pushes up and contacts the lower end of the filling up nozzle cover attached to the lower part of the filling up nozzle mechanism (not shown) during the revolution of the pouch supporting base (A1) with the pouch (α) in the filling up operation station (S2). The third operation is that in which, in the sealing operation station (S3) air is let out of the filling up mouth (α4) of the filled up pouch (α) before the filling up mouth (α4), having been put together, passes between dual heat seal bars (64)(66) and then cooled. The fourth operation involves the pouch (α) being separated and removed from the holding holes (36*c*) of the pouch supporting base (A1) by hanging and sandwiching both sides of the mouth (α4) of the hermetically sealed pouch (α) and the pouch supporting base (A1) is collected in the pouch supporting base collecting operation station (S4).

The pouch supporting base conveying path (R), which passes through the pouch dropping operation station (S1), the sealing operation station (S3) and the pouch supporting base collection operation station (S4) except the filling up operation station (S2), may possibly be plural-tracked. In such a case, the first, the third, and the fourth operations are simultaneously performed.

An embodiment of a line constructed in accordance with this invention will be explained with reference to FIGS. 6 and 7.

A seal line (B) for automatically filling the pouch (α) at high speed according to this invention includes the first to eighth conveyors (C1)–(C8) fo circularly conveying the pouch supporting bases (A1) for which the endless circular conveying path (R) passes through or connects the pouch dropping operation station (S1), the filling up operation station (S2), the sealing operation station (S3) and the pouch supporting base collecting station (S4). A pouch supplying and dropping operation system apparatus (D) is installed in the pouch dropping operation station (S1) and drops the expanded pouch (α) supplied one by one from a pouch stacker (68) and turns from the horizontal position to the bottom up perpendicular position. A rotary filling up apparatus (E) is installed in the arranged to fill operation station (S2) and filling up the fixed amount of substance in the pouch (α) as soon as the push-up plate (36) of the revolving pouch supporting base (A1) pushes up the lower end of each corresponding filling up nozzle cover (42) attached to the lower part of the filling up nozzle mechanism (40). The sealing operation system apparatus (F) which is installed in the sealing operation station (S3) lets air out of the filling up mouth (α4) by narrowing the lower part of the filling up mouth (α4) of the filled up pouch (α) from both sides and simultaneously seals the put together edges of the filling up mouth (α4) after both sides of the mouth (α4) are sandwiched. The pouch removing apparatus (G) which is installed in the pouch supporting base collecting operation station (S4) separates the hermetically sealed and filled up pouch (α) from the holding hole (36*c*) of the pouch supporting base (A1) by hanging and sandwiching both sides of the mouth (α4) and collects the empty pouch supporting base (A1), so that a consistant system line may be formed by connecting the above stations in turn.

Additionally, (H), shown in drawings, are discharge conveyors which discharge the hermetically sealed and filled up pouches (α) conveyed from the pouch removing apparatus (G) and whose entry ends are coupled to terminal ends of the pouch supporting base collecting operation station (S4).

Figure 6:
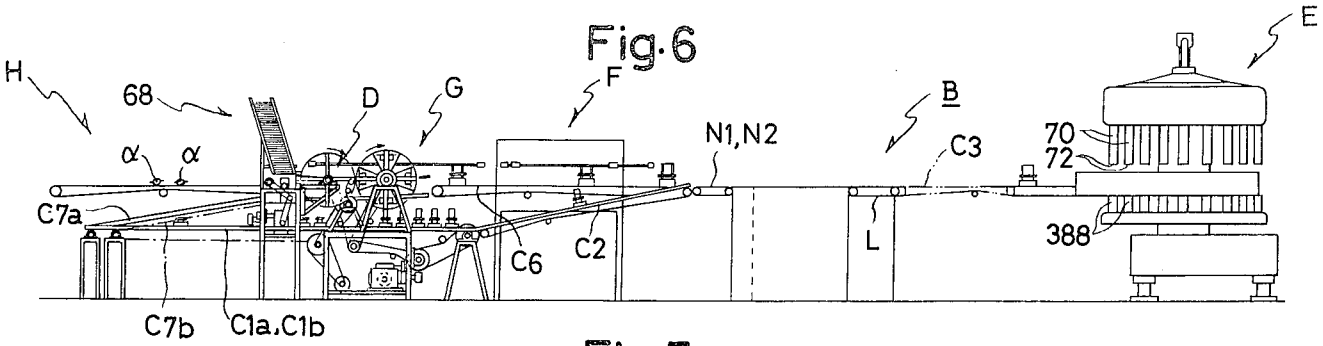
FIGS. 6 and 7 are respectively a front view and a plan view showing a layout constructed in accordance with this invention.
Figure 7:
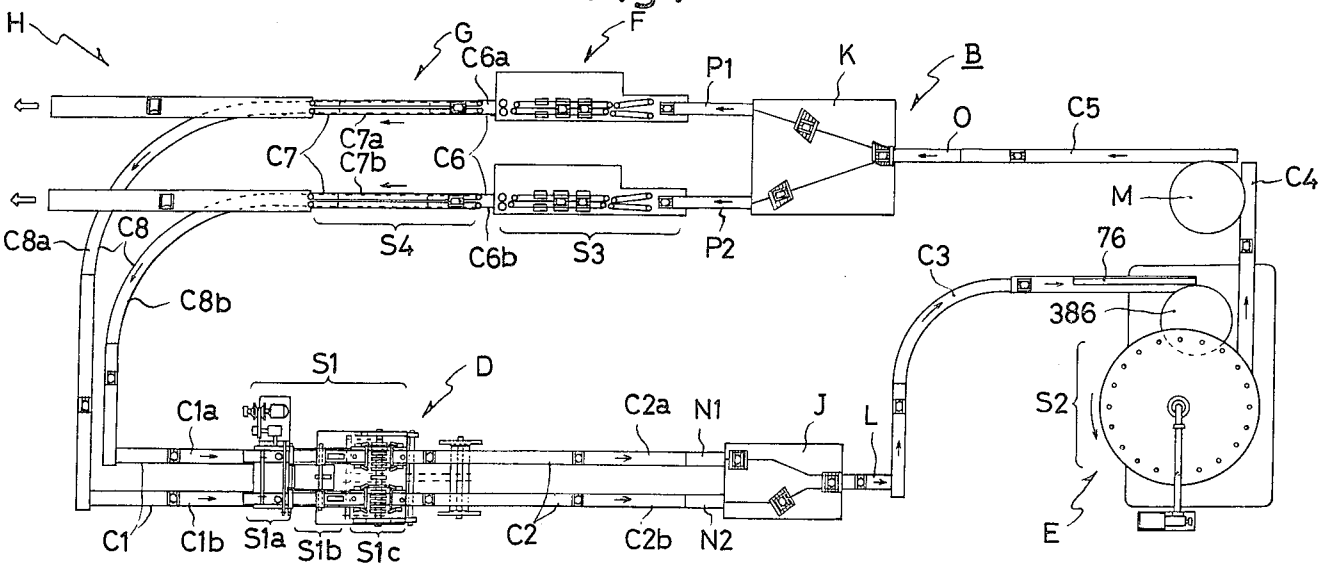

The first to eighth conveyors C1–C8, as shown in FIGS. 6 and 7, comprise the first conveyors (C1*a*)(C1*b*) of the finger chain type with feed nails (74) passing through the pouch dropping operation station (S1) in parallel with each other and conveying the pouch supporting base (A1) in spaced relation. The second conveyors (C2*a*)(C2*b*) of the inclined belt type have entry ends coupled in series to terminal ends of the first conveyor (C1*a*)(C1*b*) respectively. The third conveyor (C3) is of the curve type coupled to the entrance of the filling up operation station (S2) and has a timing screw (76) along the entrance side. The fourth conveyor (C4) is coupled to the exit of the filling up operation station (S2), the fifth conveyor (C5) has an entry end coupled at a right angle to the terminal end of the fourth conveyor (C4), and the sixth conveyors (C6*a*)(C6*b*) of the belt type passes through the sealing operation station (S3) and the pouch supporting base operation station (S4) in parallel with each other. The seventh conveyor (C7*a*)(C7*b*) is of the straight type and the eighth conveyors (C8*a*)(C8*b*) are of the curve type whose entry ends are coupled to the terminal ends of the seventh conveyors (C7*a*)(C7*b*) and which collect only empty pouch supporting bases (A1). The second conveyors (C2*a*)(C2*b*) and the third conveyors (C3*a*)(C3*b*) are connected to a converger (J) already sold on the market. The fifth conveyor (C5) and the sixth conveyors (C6*a*)(C6*b*) are connected to a channeliser (K) already sold on market. The terminal ends of the eighth conveyors (C8*a*) (8*b*) are coupled at right angle to the entry ends of the first conveyors (C1*a*)(C1*b*), while the empty pouch supporting base (A1) smoothly changes its own direction to a right angle direction without changing conveying posture. The third conveyor (C3) is connected to the converger (J) at a right angle through an exit adjusting conveyor (L) connected to the exit side of the converger (J) to smoothly change the forward direction of the pouch supporting base (A1) to a right angle direction without changing the conveying posture. The fourth conveyor (C4) and the fifth conveyor (C5) are coupled at a right angle through a turntable (M) to smoothly change the forward direction and conveying posture of the pouch supporting base (A1) to a right angle direction.

Figure 8:
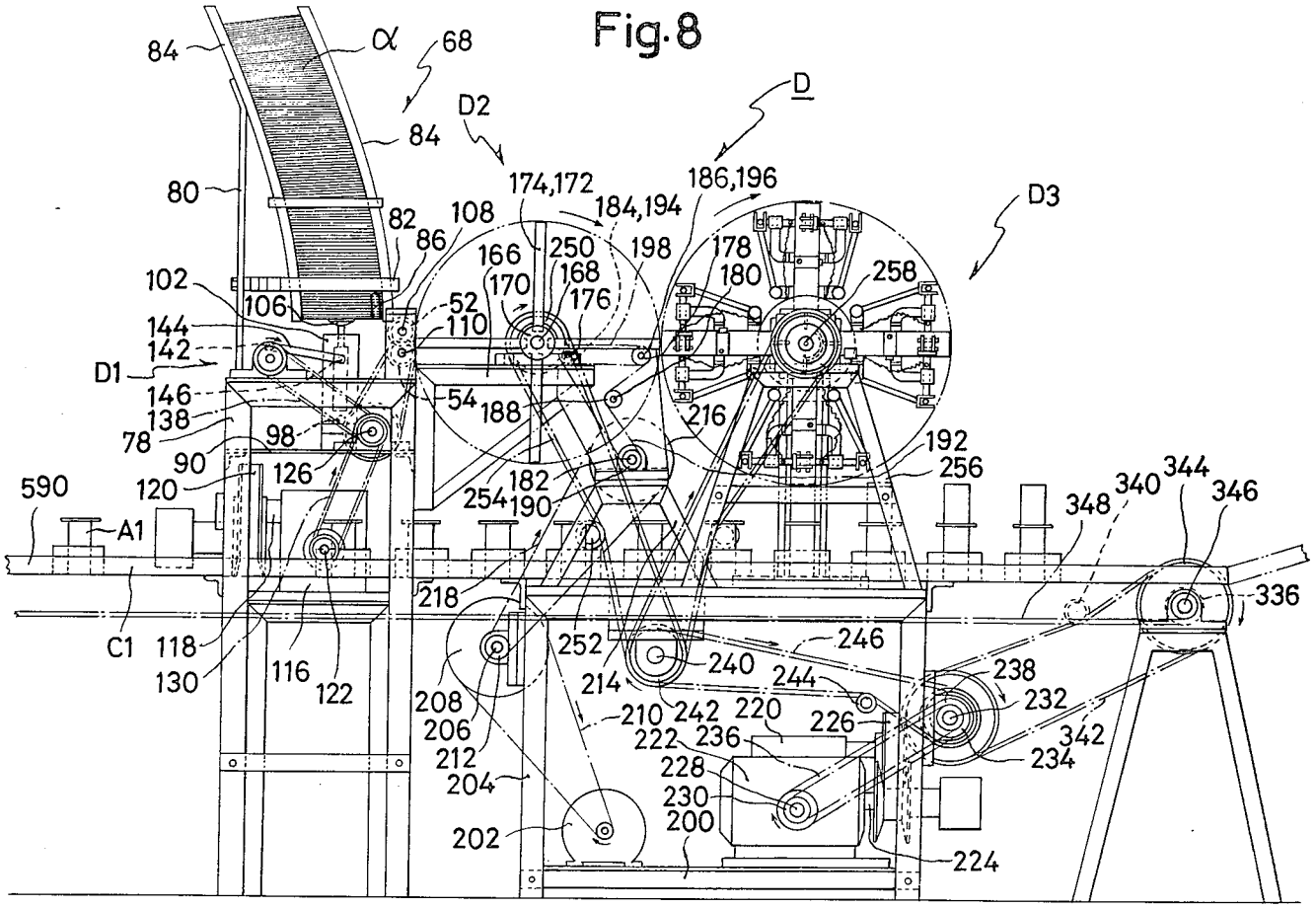
FIGS. 8 and 9 are respectively a front view and a plan view showing a pouch supplying and throwing operation system device.
Figure 9:
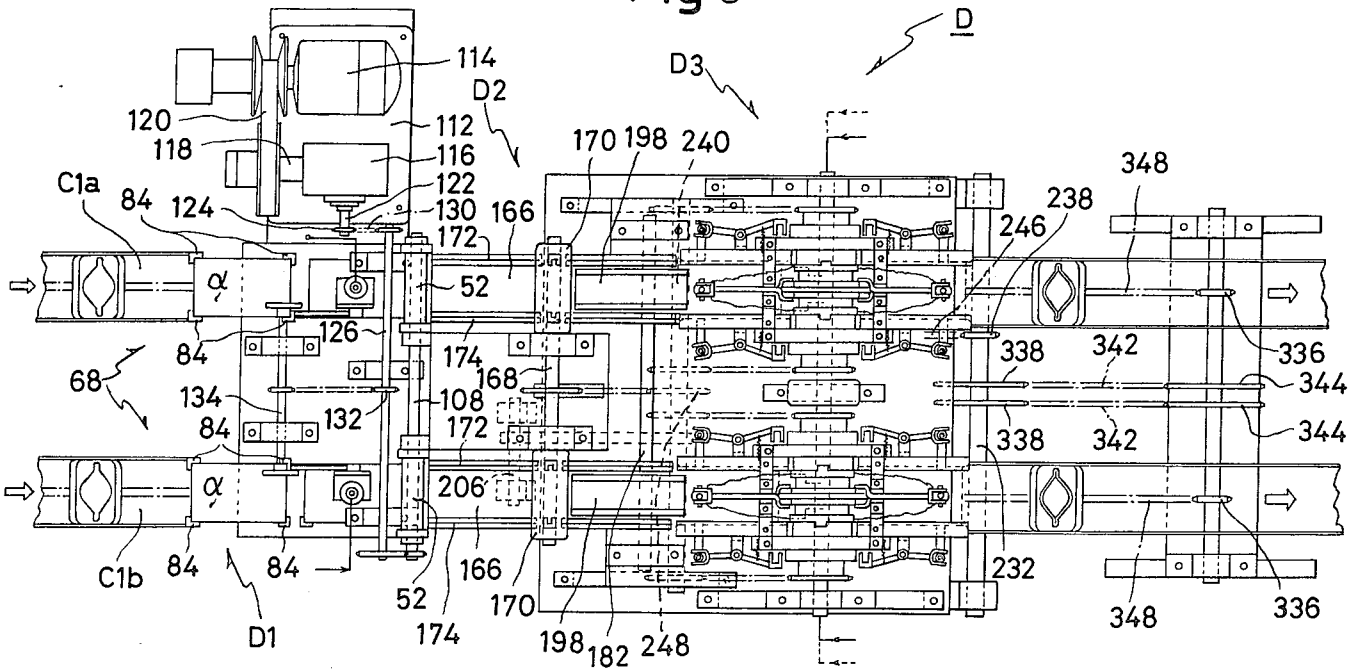

As shown in FIGS. 8 and 9, the pouch supplying and dropping operation system apparatus (D) comprises a pouch supplying apparatus (D1) installed in the preceding section (S1*a*) of the pouch dropping operation station (S1) for removing the lowest pouch (α). These are supplied one by one intermittently, by a knurling tool (86), from the piled pouch (α) in the stacker (68) of which four corners are formed by arch-shaped frame pillars (84) supported by a supporting guardrail (80) and a supporting arm (82) standing on a supporting frame (78) spanning over the first conveyor (C1). A pouch turn-over delivery apparatus (D2) is installed in the middle section (S1*b*) of the pouch dropping operation station (S1) for turning over the pouch (α) supplied from the pouch supplying apparatus (D1) before delivering it horizontally. A pouch dropping apparatus (D3) is installed in the latter section (S1*c*) of the pouch dropping operation station (S1) for opening and dropping the pouch (α) turned to the bottom up to a perpendicular position from the horizontal position at which the pouch (α) is delivered from the pouch turn-over delivery apparatus (D2). The pouch turn-over delivery apparatus (D2) and the pouch dropping apparatus (D3) are connected parallel.

Figure 10:
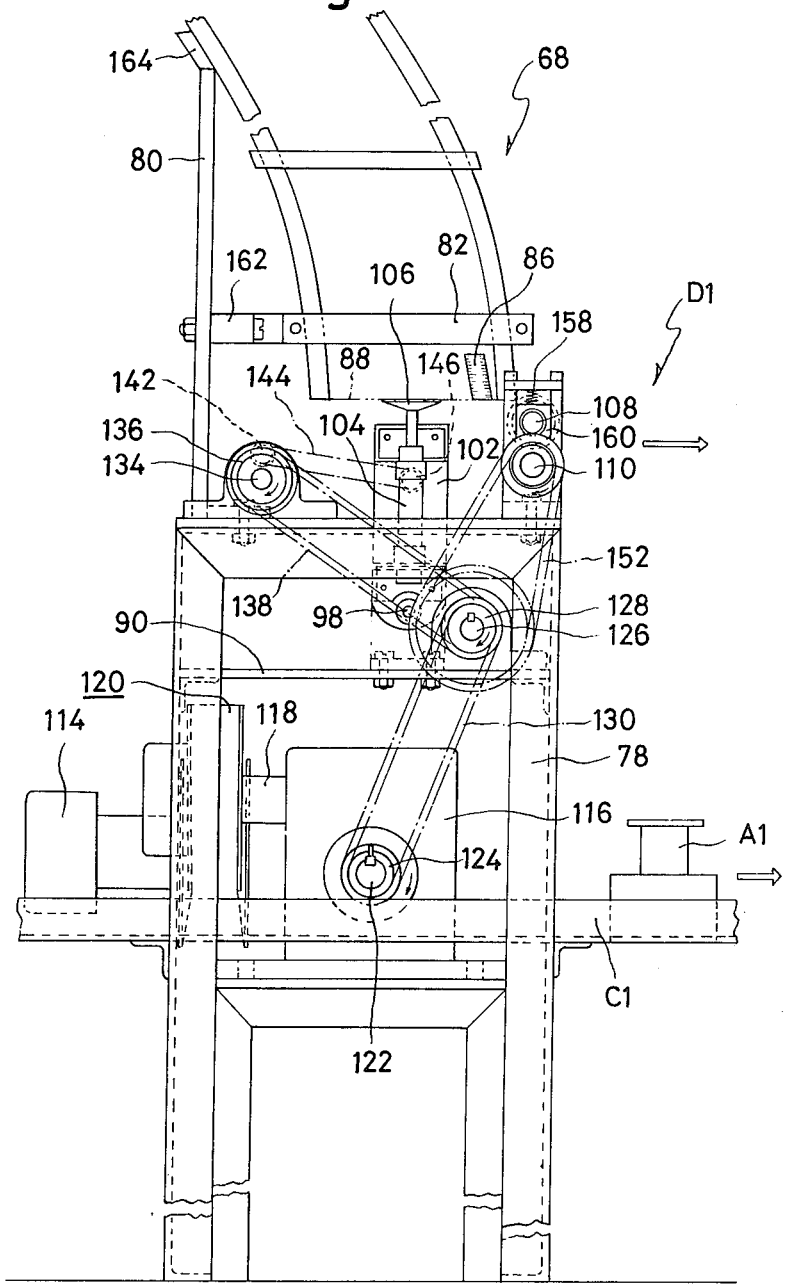
FIGS. 10 and 11 are respectively a front view and a right side view showing a pouch supplying apparatus.
Figure 11:
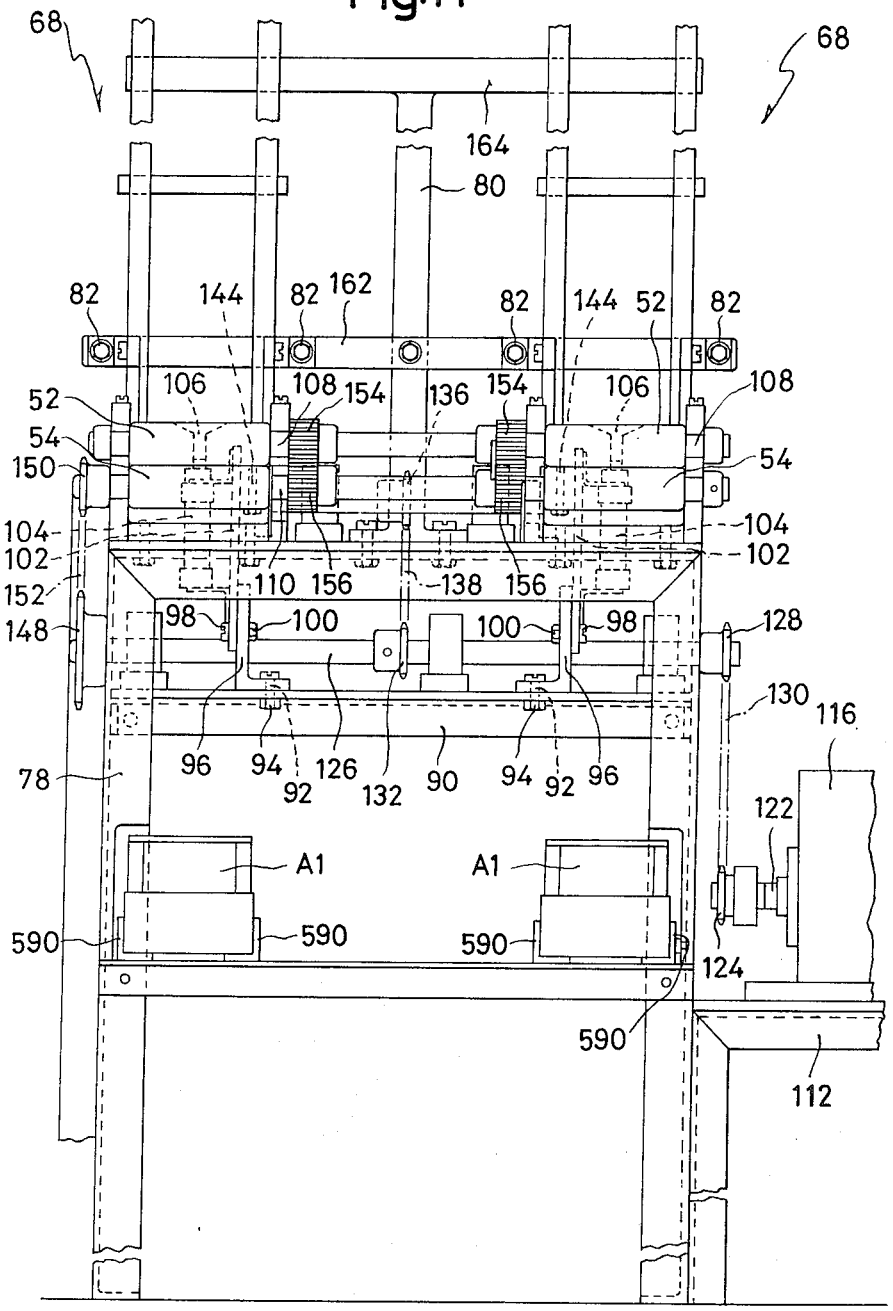

As shown in FIGS. 10 and 11, the pouch supplying apparatus (D1) has vacuum cups (106), which are freely inclined in the forward direction, projected from the top end of the cylinder (104) at the lower end mouth (88) of the pouch stacker (68) piling a plurality of flat folded pouches (α). The cylinder (104) is attached to a swinging plate (102) of which lower a part is swingingly pivoted on a L-shaped member (96) with a shaft bolt (98) and a nut (100). The L-shaped member (96) is fixed with a bolt (92) and a nut (94). Upper and lower draw-in rolls (52)(54) are installed just in front of the lower end mouth (88) of the pouch stacker (68) with shafts (108) (110). Torque of a driving motor (114) on a shelf (112) is transmitted through a pulley belt (120) to an input shaft (118) of a reduction gear (116). A chain (130) is endlessly stretched between a sprocket (124) fixed to an output shaft (122) of the reduction gear (116) and a sprocket (128) is fixed to one end of a relay shaft (126). A chain (138) is endlessly stretched between a sprocket (132) fixed to the intermediate portion of the relay shaft (126) and a sprocket (136) fixed to intermediate portion of the driving shaft (134). At both ends of the driving shaft (134) are fixed circular crank plates (140). One end of a link (144) is connected to a crank pin (142). Another end of the link (144) is pivotally connected to a pin (146) of the swinging plate (102). Between a sprocket (148) fixed to the end of the relay shaft (126) and a sprocket (150) fixed to the shaft (110) a chain (152) is endlessly stretched. A gear (154) fixed to the shaft (108) and a gear (156) fixed to the shaft (110) are respectively meshed with each other. The pouch (α) reaching the lowest end of the pouch stacker (68) are gripped and taken out one by one of the vacuum cups (106) and drawn in to the upper and lower draw-in rolls (52)(54).

In the drawings, (158) is a back-up coil spring which brings downward pressure on the slide bearing (160) of the shaft (108), (162) are cross bars which connect the supporting bar (80) with the arm bars (82), and (164) are cross bars which directly connect the supporting bar (80) with the frame pillar (84).

As shown in FIGS. 8 and 9, the pouch turn-over delivery apparatus (D2) has a pair of radially protruding blade arms (172) (174), disposed in equal-spacedly 90° directions of boss rings (170) fixed to a rotating shaft (168) transversely installed in the shelf (166) of the supporting frame (78), so as to hold both end seam edges (α1)(α2) of the pouch (α) fed from the upper and lower draw-in rolls (52)(54) of the pouch supplying apparatus (D1). In the horizontal position between rotating blade arms (172)(174) of the side of the pouch dropping apparatus (D3), a transmission belt (192) is endlessly stretched through rollers (184)(186)(188)(190) fixed to shafts (176)(178)(180)(182) respectively, with free transmission of torque, and a delivery conveyor (198) is endlessly stretched between the rollers (194)(196) fixed to the shafts (176)(178) respectively. Driving torque is transmitted through a pulley belt (210) to a large pulley (208) fixed to a shaft (206) transversly and rotatingly attached to one end of a leg frame (204) support the first conveyor (C1). A pulley belt (218) is endlessly stretched between a small pulley (212) coaxially fixed to the shaft (206) and a large pulley (216) fixed to the shaft (182) attached transversely and rotatingly to a small tower frame (214) on the leg frame (204). On the other hand, driving torque of a driving motor (220) on a frame floor plate (200) is transmitted through a pulley belt (226) to an input shaft (224) of a reduction gear (222). A chain (236) is endlessly stretched between a sprocket (234) fixed to an output shaft (228) end of the reduction gear (222) and a sprocket (234) fixed to a shaft (232) attached transversely and rotatingly to the other end of the leg frame (204). A chain (246) is endlessly stretched through a small sprocket (244) between a sprocket (238) fixed coaxially to the shaft (232) and a sprocket (242) fixed to an intermediate shaft (240). A chain (254) is endlessly stretched through a small sprocket (252) between a sprocket (248) fixed coaxially to the intermediate position of the shaft (240) and a sprocket (250) fixed to the intermediate position of the rotating shaft (168). When the parallel blade arms (172)(174) holding both end seam edges (α1)(α2) of the pouch (α) pass both sides of the delivery conveyor (198), the pouch (α) is put on the delivery conveyor (198) and forwarded to the pouch dropping apparatus (D3).

Figure 12:
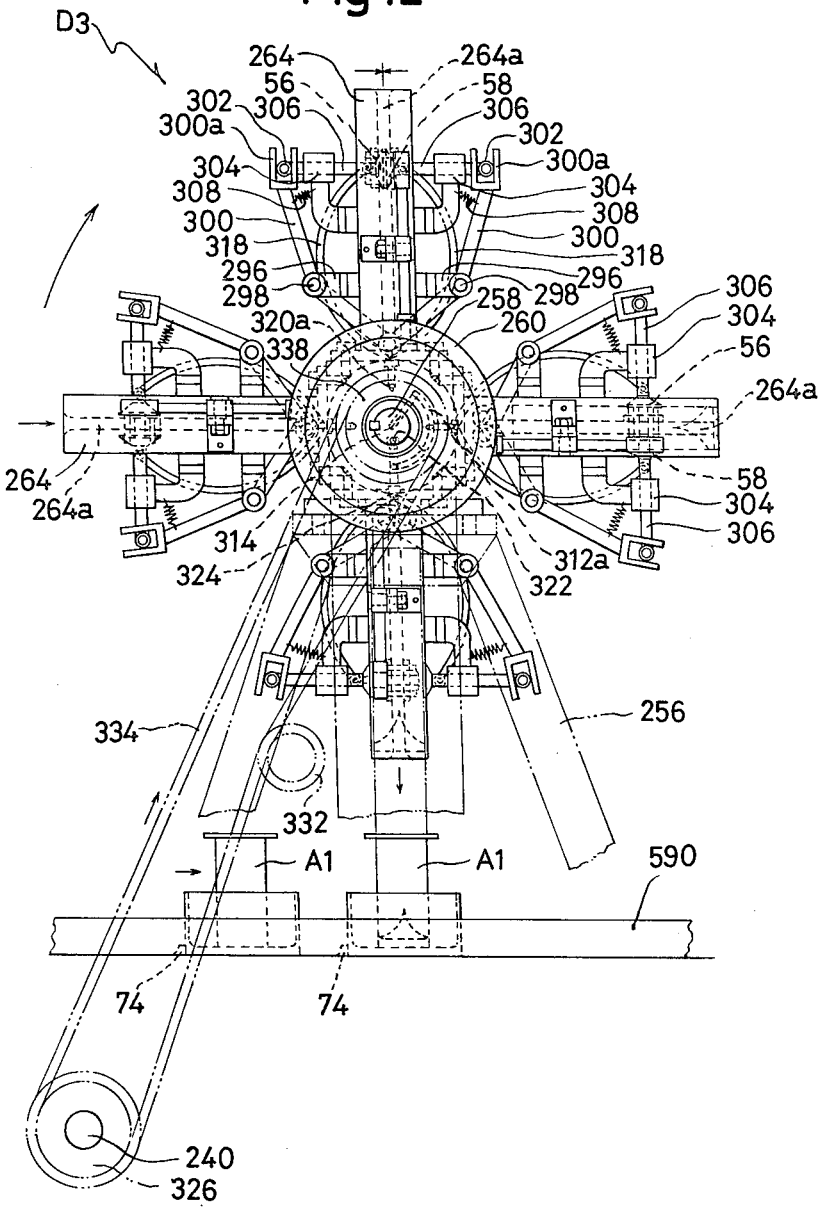
FIGS. 12 and 13 are respectively a front view and a left side view showing a pouch throwing apparatus.
Figure 13:
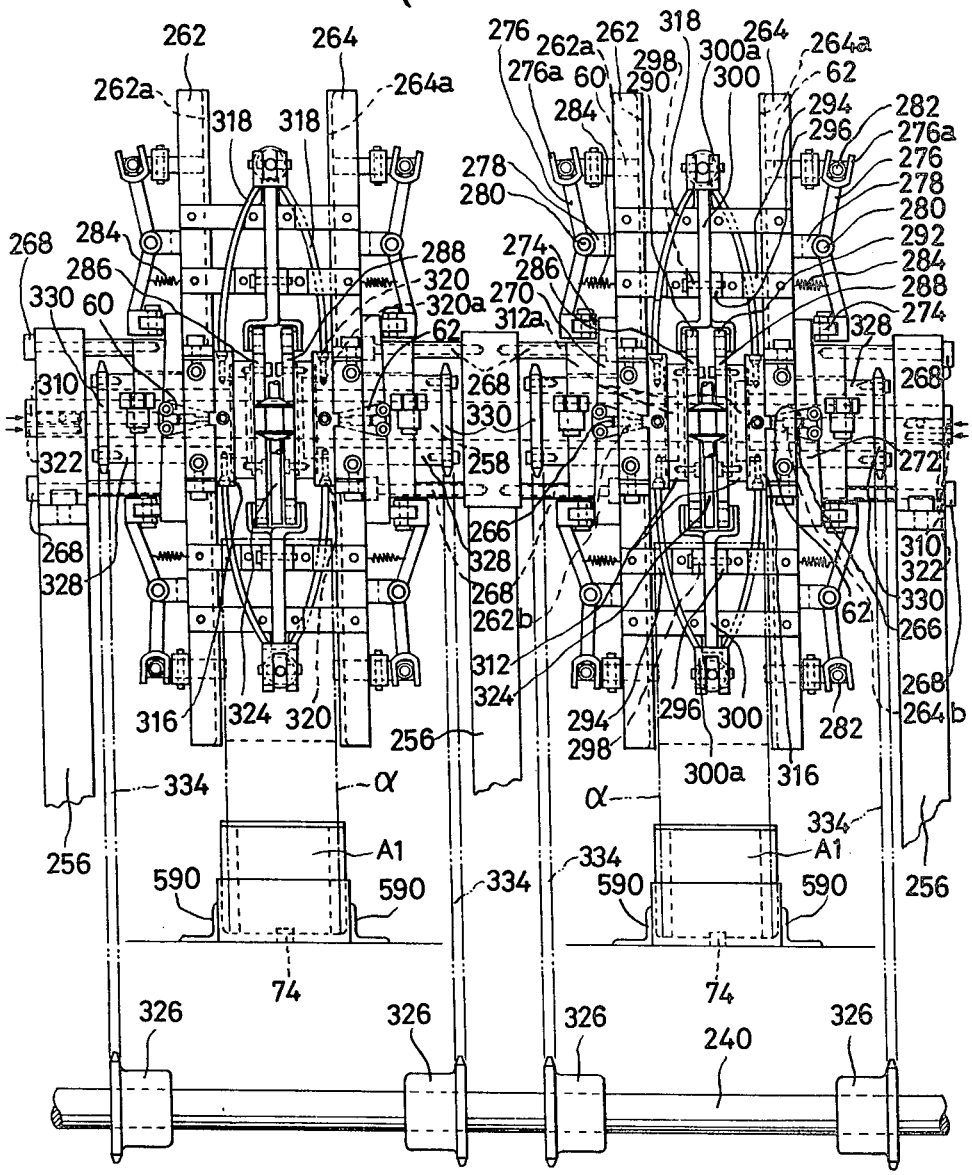

As shown in FIGS. 12 and 13, the pouch dropping apparatus (D3) has a pair of parallel radially projecting guide blades (262)(264) extending at 90°, equally spaced on each outer side of a boss block (260) attached rotatingly to a fixed shaft (258) transversely fixed to a large tower frame (256) on the leg frame (204). A pair of parallel guide blades (262)(264) are formed on the opposed faces thereof with guide grooves (262*a*) (164*a*) guiding and inserting both end seam edges (α1)(α2) of the pouch (α) fed from the delivery conveyor (198) of the pouch turn-over delivery apparatus (D2). The grip pushers (60)(62) freely push up both end seam edges (α1)(α2) near to the bottom end (α3) of the pouch (α) into the guide grooves (262*a*)(264*a*) when the inserted and held pouch (α) is expanded. The grip pushers (60)(62) tend to be maintained wide-open at the rear ends thereof by the spring (266). The middle portion of a bent-up lever (276) is pivoted to a supporting bracket (278) projected from the outer surface of the parallel guide blades (262)(264) with a pin shaft (280). To one end of the bent-up lever (276) is respectively attached a cam follower (274) contacting a pair of cylindrical cams (270)(272) penetrating through the fixed shaft (258) and fixed to the large tower frame (256) with a long fixed stay bolt (268). A roller (282) engaged by the other forked end (276*a*) of the bent-up lever (276) is attached to the outer end of the grip pushers (60)(62). The grip pushers (60)(62) wedge into wedge holes (262*b*)(264*b*) bored in guiding grooves' (262*a*) (264*a*) at bottom of parallel guide blades (262)(264) by a tension coil spring (284). The grip pushers (60)(62) always tend to be drawn in to the guiding groove (262*a*)(264*a*) bottoms. A pair of vacuum cups (56)(58) engage both side surfaces of the pouch (α) and are formed to communicate with mouth pieces (320) through vacuum pipes (318). The middle portion of a bent-up lever (300) is pivoted to a supporting bracket (296) projected from the middle of a bridge bar (294) with a pin shaft (298). The bridge bar (294) is bridged between the parallel guide blades (262)(264). To one end of the bent-up lever (300) are attached cam followers (290)(292) contacting circumferential cam surfaces of parallel fix plate cams (286)(288) fixed to the fixed shaft (258) between the parallel guide blades (262)(264). By fixing the rollers (302) engaged by the other forked end (300*a*) to the outer ends thereof and the internal ends of a rod (306) penetrating through a guiding cylinder (304) on the way, the vacuum cups (56)(58) are presented to engage opposite side surfaces of the pouch (α) in the middle between the parallel guide blades (262)(264). The vacuum cups (56) (58) are always urged into the contact region by the action of the tension coil spring (308). Additionally, a vacuum hole (310) bored along the center of the fixed shaft (258) communicates through a radial hole (314) with a vacuum groove (312*a*) made to the bottom up perpendicular position from the approximately 45° clockwise position from the upward perpendicular of both side surface of a boss plate (312) accompanying with the reverse surface of the parallel fixed cam plate (286)(288). On the circumference of a friction plate (316) united with the boss block (260) with 90° spaced interval, attached mouthpieces (320) are buried to connect ends of the vacuum cups (56)(58) with the other ends of the vacuum pipes (318). Internal end mouths (320*a*) of the attached mouthpieces (320) are opened in the corresponding radial position to the vacuum groove (312*a*) in the corresponding contact sliding surface to the side surface of the boss plate (312) of the friction plate (316). The air hole bored in the center of the fixed shaft (258) is formed to communicate with the air nozzle (324) in the bottom up perpendicular position between the parallel fixed plate cams (286)(288). A chain (334) is endlessly stretched, on the way through a small sprocket (332), between sprockets (326) fixed coaxially to the intermediate shaft (240) and each of sprockets (330) fixed respectively to the one end of the cylindrical sleeves (328) of which the other end is fixed to the reverse surface of the boss block (260) inserted between the fixed shaft (258) and each of the cylindrical cams (270).

In FIGS. 8 and 9, (336) is a motive action sprocket of a conveyor chain (349) with nails fixed to motive action shaft (346) to which a large sprocket (344) is coaxially fixed. Between a large sprocket (334) fixed to the intermediate position of the shaft (232) and a large sprocket (344) a chain (342) is endlessly stretched through a small sprocket (340).

Figure 14:
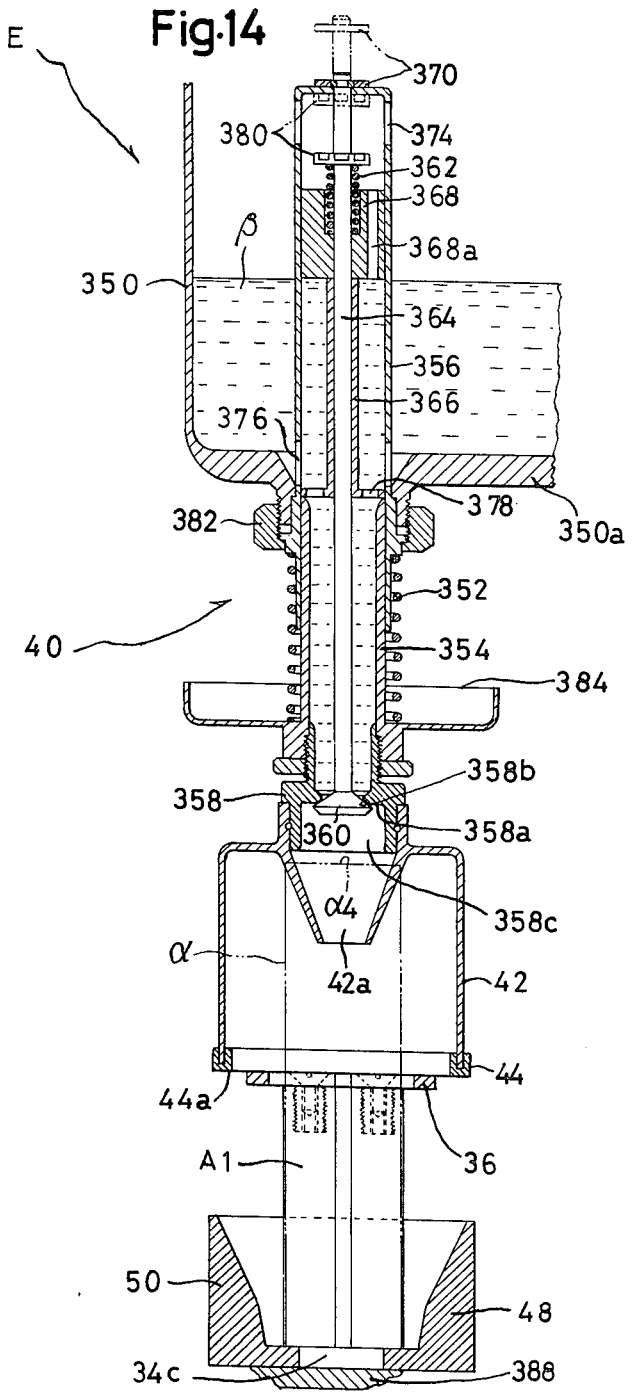
FIG. 14 is an enlarged central sectional view showing the relation between a pouch supporting base and a filling up nozzle mechanism equipped with a rotary filling up apparatus in the filling up operation.

As shown in FIGS. 6, 7 and 14, the rotary filling up apparatus (E) is an improved one for pouches (α) acquired by improving the lower end of the filling up nozzle apparatus equipped with a tank (350) of the filling up apparatus for caps or bottles already sold on the market. Quantity liquid pouring tubes (356), in which slide sleeves (354) are inserted, penetrate at space position into a bottom surface (350*a*) of the tank (350). The slide sleeves (254) are urged downwardly by compression coil spring (352). Into a lower mouth of the slide sleeve (354) is screwed a valve mouth (358) providing a tip receiving seat opening (358*b*) on the middle of a downward facing concave surface (358*a*). A nozzle tip (360) which fit to the tip receiving seat opening (358*b*) is fixed to a lower end of a stem (364). The stem (364) is urged upwardly by a depressed coil spring (362) extending through the axis of the slide sleeve (354). The guidance tube (366) is installed to move up and down within the quantity liquid pouring cylinder (356), and the cylinder block (368) which has the flow hole (368*a*). Stop ring (370) is fixed to the top of the stem (264) piercing through the ceiling end of the quantity liquid pouring cylinder (356) to freely contact with the outer upper surface thereof. The stem (364) is hung vertically by the stop ring (370). Around the valve mouth (358) is externally provided the filling up nozzle cover (42) having a nozzle mouth (42*a*) attached in a downward disposition to the ceiling portion thereof. The nozzle cover (42) has a lower end opening mouth edge (44*a*) including an elastic body (44) contacted and pushed up by the push-up plate (36) of the pouch supporting bases (A1) in filling up in the pouch (α) and the nozzle mouth (42*a*) directly communicates with the downward concave portion (358*c*) of the valve mouth (358). The filling up mouth (α4) of the pouch (α) contacts and matches to the nozzle mouth (42*a*). The rotary filling up apparatus (E) is provided with the filling up nozzle mechanism (70) formed as above.

In the drawings, (β) is liquid, (374)(376)(378) are openings, (380) is a spring receiver, (382) is an attached joint nut, (384) is a tray cover for catching drops, and (386) is a star wheel by which the pouch supporting bases (A1) supplied intermittently from the third conveyor (C3) by the timing screw (76) are fed to pockets (not shown) arranged spacedly and then delivered to each lifter (388) of the rotary filling up apparatus (E)

Figure 15:
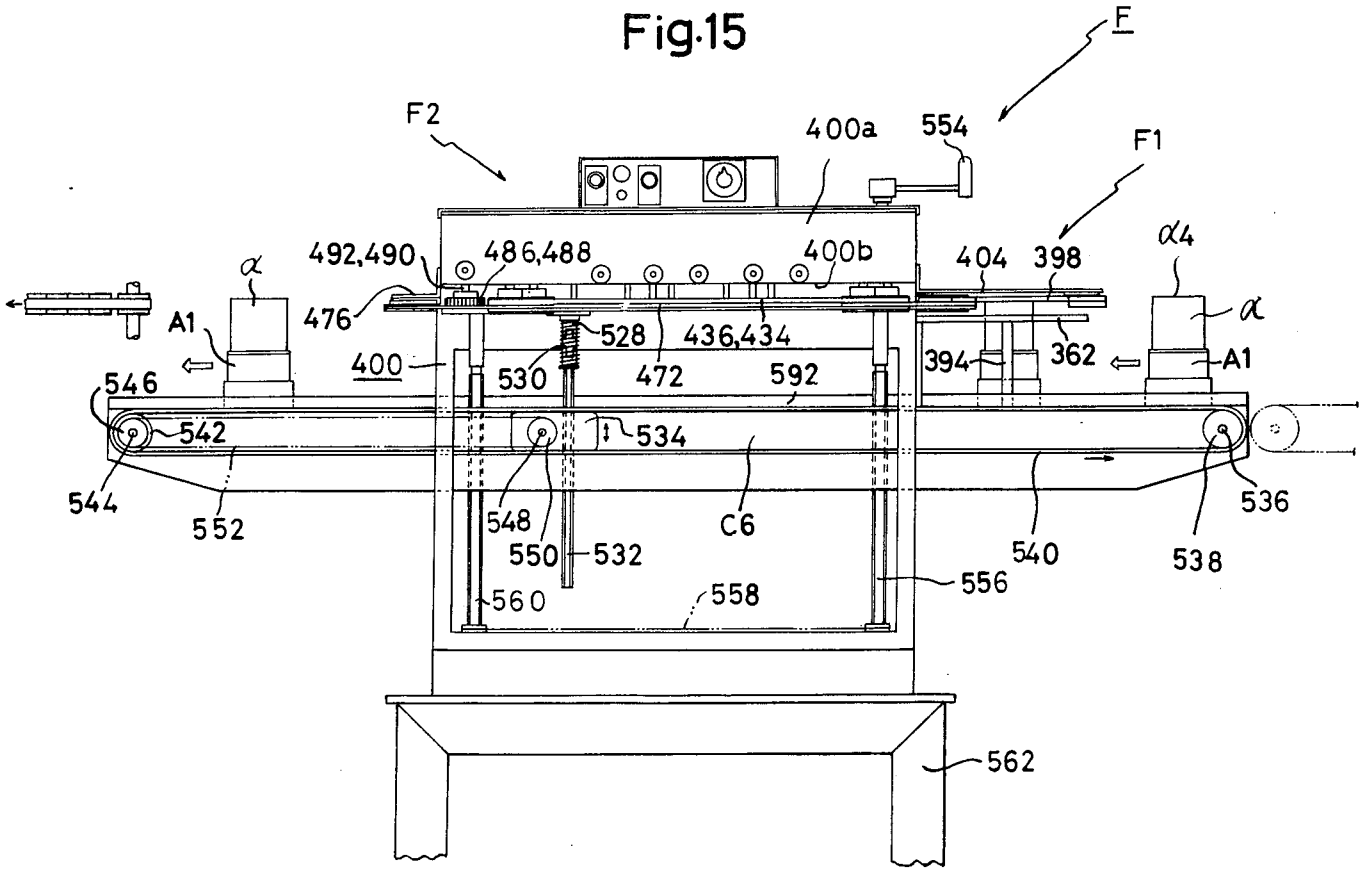
FIGS. 15 and 16 are respectively a front view and a plan view showing a sealing operation system device.
Figure 16:
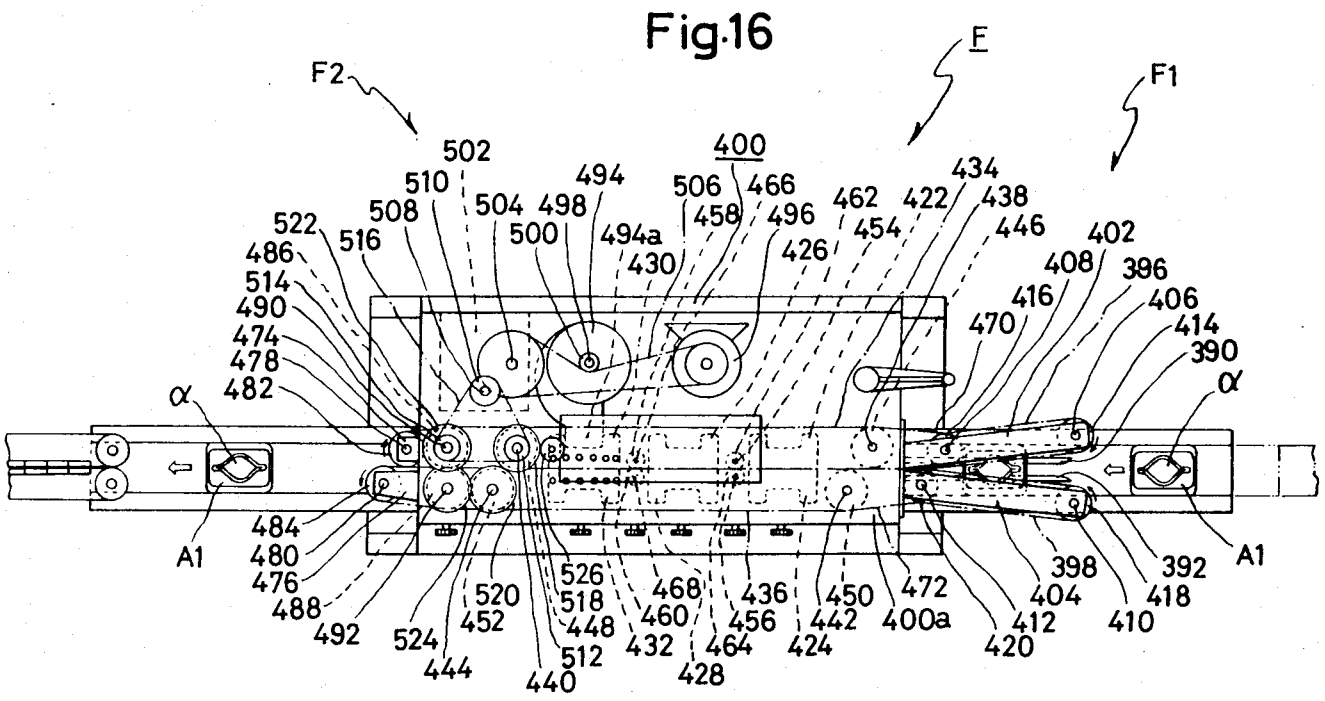

As shown in FIGS. 15 and 16, in the seal operation system apparatus (F) the lower part of filling up mouth (α4) of the filled up pouch (α) stably held by the pouch supporting base (A1) travelling on the entry end of the sixth conveyor (C6) is narrowed, from both sides, by a pair of degassing guide bars (390)(392) to let air out of the filling up mouth (α4). The degassing guide bars (390)(392) extend parallel with a supporting bar (394) standing on both sides of the sixth conveyor (C6). Above degassing guide bars (390)(392), gradually sandwich and close the filling up mouth (α4) end of the filled up pouch (α), a pair of different length sandwich stretch belts (396)(398) are endlessly stretched between racing pulleys (414) and (416), (418) and (420), through fastening shafts (406)(408)(410)(412) fixed to arm bars (402)(404) projected from one end of a ceiling portion (400*a*) of the frame (400). The space between the stretch belts (396)(398) gradually narrows toward the advance direction. A pair of seal bands (434)(436) sandwiching both sides of the closed filling up mouth (α4) end of the filled up pouch (α) passes, successively between the first seal bars (422)(424), the second seal bars (426)(428), and cooling fan bars (430)(432). A pair of seal bands (434)(436) are endlessly and parallel stretched between pulleys (446)(448) and pulleys (450)(452). The pulleys (446)(448) and (450)(452) are perpendicularly and racingly attached to the beginning and the terminal end sides of a ceiling (400*b*) of the frame (400) through shafts (438)(440)(442)(444) respectively. The seal bands (434)(436) pass on the way between small rolls (458)(460) and (462)(464), which rolls are perpendicularly attached to the ceiling (400*b*) through shafts (454)(456)(466)(468). Below and along the seal bands (434)(436), a pair of pouch guidance belts (470)(472) which guide and regulate both sides of the filling up mouth (α4) of the filled up pouch (α) are endlessly, horizontally and parallel stretched between pulleys (416)(420) of the pouch filling up mouth close apparatus (F1) and pulleys (482)(484) racingly attached through fastening shafts (478)(480) to brackets (474)(476) projected from the end of the ceiling portion (400*a*) of the frame (400), on the way through pulleys (446)(448)(450)(452), respectively. The filling up mouth seal apparatus (F2) is constituted as above.

In the drawings, (486)(488) are a pair of knurled marking rolls existing between pulleys (448)(482) and pulleys (452) (484). These are perpendicularly fixed to shafts (490)(492) extending through the terminal end of the ceiling surface (400*b*) of the ceiling portion (400*a*) of the frame (400). (486)(488) mark knurling tool teeth on a hermetically sealed portion of the filling up mouth (α4) of each of the filled up pouches (α) discharged from the terminal ends of the seal bands (434)(436).

The pouch filling up mouth seal apparatus (F2) has a fan (494) in which a fan opening (494) faces a cooling fan bar (430). Driving torque of the driving motor (496) is transmitted through a pulley belt (506) to a input shaft (504) of a reduction gear (502), contacting a pulley (500) fixed to a shaft end (498) of the fan (494). Between a sprocket (510) fixed to an output shaft (508) end, a sprocket (512) fixed to the shaft (440) and a sprocket (514) fixed to a shaft (490), a chain (516) is endlessly stretched. A gear (522) fixed to the shaft (440) is meshed with a gear (520) fixed to the shaft (444). A gear (522) fixed coaxially to the shaft (490) is meshed with a gear (524) fixed to the shaft (492). Through a gear box (534) penetrates a slide spline shaft (532), as an input shaft, connected to the lower end of the shaft (528) fixing a gear (526) meshed with the gear (518) through an universal joint (528). A conveyor belt (540) is endlessly stretched between a motive action pulley (542) and a driven pulley (538) fixed to a driven shaft (536) transversely attached to the entry end of the sixth conveyor (C6). A chain (552) is endlessly stretched between a sprocket (546) fixed to a motive action shaft (544) end transversely attached to the terminal end of the sixth conveyor (C6) and a sprocket (550) fixed to an output shaft (548) of the gear box (538).

In the drawings, (554) is a handle by which height space between the seal bands (434)(436) and the conveyor belt (540) is adjusted. That is, the whole sixth conveyor (C6) is slightly adjusted in a longitudinal direction by a screw rod (560) incorporatedly rotated through a chain (558) by rotation of a screw rod (556) by means of operation of the handle (554) in accordance with height of the pouch (α) held by the pouch supporting base (A1). (562) is a leg frame supporting the frame (400).

Figure 17:
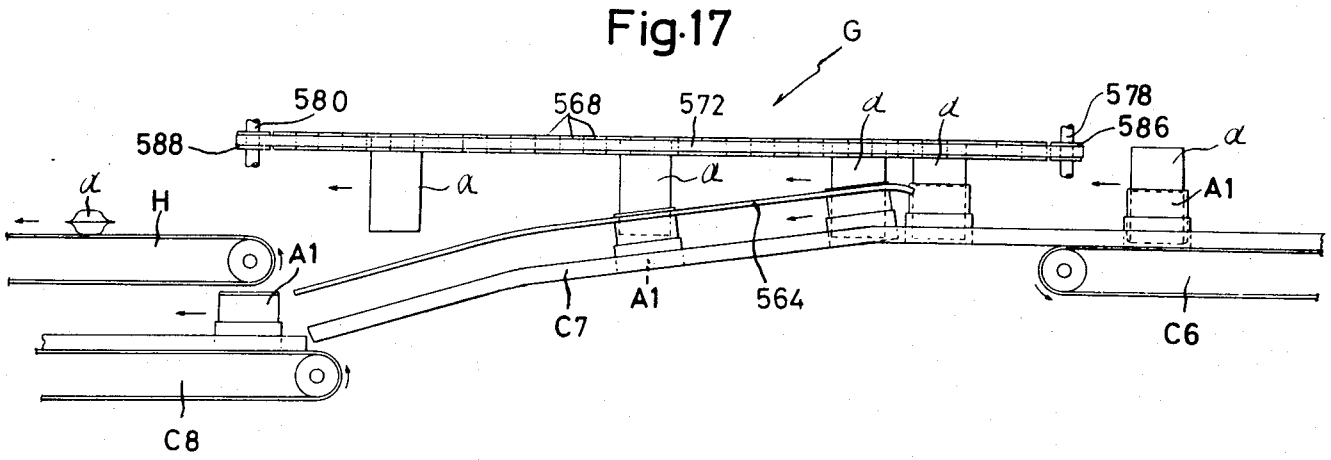
FIGS. 17 and 18 are respectively a front view and a plan view showing a pouch depriving apparatus.
Figure 18:
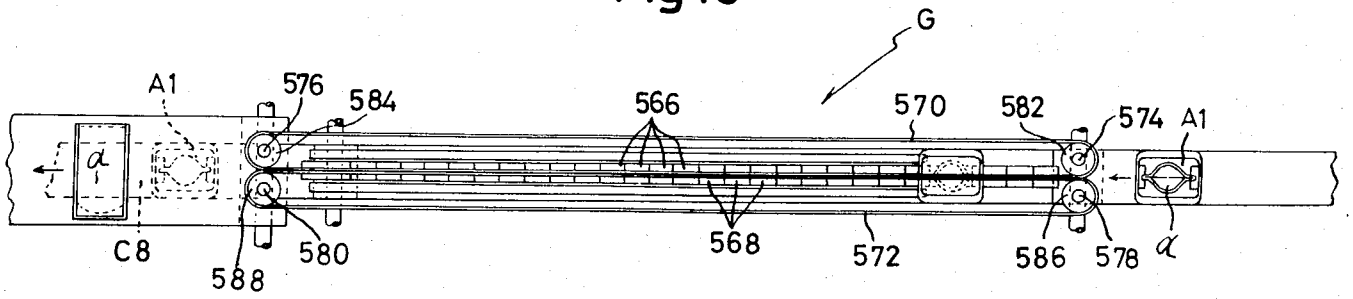

In the pouch removing apparatus (G) shown in FIGS. 17 and 18, the pouch supporting base (A1) which has reached the terminal end of the sixth conveyor (C6) moves horizontally to the seventh conveyor (C7) which is of the inclined shoot type, and is guided and slides by guide rails (564) on the seventh conveyor (C7). As the pouch (α) passes between permanent magnets (566)(568) which are continuously and facingly arranged in two rows above the seventh conveyor (C7) with both sides of the hermetically sealed end of the filling up mouth (α4) of the filled up pouch (α) standing by itself on and held by the pouch supporting base (A1), the pouch (α) is separated from the pouch supporting base (A1) with the pouch (α) sandwiched with and hanging from a pair of belts (570)(572). Between pulleys (582)(584) fixed to thrust shafts (574)(576) and pulleys (586)(588) fixed to thrust shafts (578)(580), the pair of belts are endlessly, parallel and horizontally stretched.

As the line (B) of this invention as described above, the collected empty pouch supporting bases (A) are transferred to parallel guides (590) shown in FIG. 11 on the entry ends of the first conveyors (C1*a*)(C1*b*) from the terminal ends of the eight conveyors (C8*a*)(C8*b*) without changing conveying posture, hooked with the feeding nail (74) of the finger conveyor chain (348) and then conveyed intermittently.

In parallel with this, the pouches (α) are sucked down into between the upper and lower draw-in rolls (52)(54), by releasing of the vacuum cup (106) at the same time as the preceding bottom end (α3) is sucked down between the upper and lower draw-in rolls (52)(54) by the forward inclining action of the vacuum cup (106) after the lowest pouch (α) is removed one by one from the pouch stacker (68) in which the plural folded flat pouches (α) are prepiled by the vacuum cup (106) of the pouch supplying apparatus (D1).

The pouch (α) coming out from between the upper and lower draw-in rolls (52)(54) is held by its end seam edges (α1)(α2) by a pair of the parallel blade arms (172)(174) of the pouch turn-over delivery apparatus (D2) to reach the horizontal position, at the time a 180° turn of it is over, put on the delivery conveyor (198) and forwarded horizontally. Both end seam edges (α1)(α2) of the pouch (α) are inserted into and held by the guide grooves (262*a*)(264*a*) of the parallel guide blades (262)(264) of the pouch dropping apparatus (D3) which reach the horizontal position. When the parallel guide blades (262)(264) come to the upward perpendicular position, the vacuum cups (56)(58) come close to each other as centered on the pin shaft (298) through each bent-up lever (300) against the force of coil springs (308) by contact and rotation action of parallel fixed plates cam (286)(288) and cam followers (290)(292) and then contact both side surfaces of the pouch (α). When the parallel guide blades (262)(264) come to the position turned 40° clockwise from the upward perpendicular position, since internal end mouths (320*a*) of attached mouthpieces (320) begin to communicate with the arc-shaped vacuum groove (312*a*), the vacuum cups (56)(58) engage both side surfaces of the pouch (α) through vacuum pipes (318). From this point, the vacuum cups (56)(58) begin to move apart through a bent-up lever (300) by contact and rotating action of parallel fixed plate cams (286)(288) and cam followers (290)(292), and simultaneously the grip pushers (60)(62) are gradually projected from the bottoms of the guide grooves (262*a*)(264*a*) through the bent-up lever (276) against the force of coil springs (284) by contact and rotating action of the cylindrical cam (270) and each cam follower (274). Push pressure by the grip pushers (60)(62) against both end seam edges (α1)(α2) of the pouch (α) further open the pouch (α).

At the time the parallel guide blades (262)(264) come to the horizontal position, the pouch (α) is perfectly opened. In addition, just before the parallel guide blades (262)(264) come to the bottom up perpendicular position, communicating with an inner end mouth (320*a*) of an attached mouthpiece (320) blocks the vacuum groove (312*a*) and thus, release of the vacuum cups (56)(58) results. At the time the parallel guide blades (262)(264) come to the bottom up perpendicular position, since an air aperture (322) communicates with an air nozzle (324), air is blasted into the opened pouch filling up mouth (α4) from the air nozzle (324) to expand the pouch (α), while the pouch (α), by thrust of the grip pushers (60)(62) out of the guide grooves (262*a*)(264*a*) of the parallel guide blades (262)(264), is dropped from between the bottom up perpendicular parallel guide blades (262)(264). The dropped pouch (α) is dropped into and stands by itself on the holding hole (36*c*) penetrated through the push-up plate (36) of the pouch supporting base (A1) conveyed by the first conveyors (C1*a*)(C1*b*) passing below the pouch dropping apparatus (D3).

The pouch supporting base (A1) containing and holding the pouch (α) travels on the first conveyors (C1*a*)(C1*b*) ascends the incline of the second conveyors (C2*a*)(C2*b*) and reaches the entrance adjusting conveyor apparatus (N1)(N2). At the line automatic collecting apparatus (J), two rows of the pouch supporting base (A1) are changed into a single row, therefore the pouch supporting bases (A1) are conveyed to the exit adjusting conveyor apparatus (L) in a single row. The pouch supporting bases (A1) are transmitted at a right angle from the terminal end of the exit adjusting conveyor apparatus (L) to the third conveyor (C3) without conveying posture change. When the pouch supporting bases (A1) approach the terminal end area of the third conveyor (C3), the pouch supporting bases (A1) are spacedly fed into the star wheel (386) by the timing screw (76). Then the pouch supporting bases (A1) are transmitted to each lifter (388) corresponding to the filling up nozzle mechanism (40) of the rotary filling up apparatus (E).

While the pouch supporting bases (A1) on the filters (388) are turned, the raising of the lifter (388), as shown in FIG. 14, makes the push-up plate (36) of the pouch supporting bases (A1) push up and contact the lower end opening edge (44*a*) of the filling up nozzle cover (42). Successively, the nozzle opening (42*a*) is placed into the filling up mouth (α4) of the pouch (α) and simultaneously the slide sleeve (354) is lifted against the force of the depressed coil spring (352) through the filling up nozzle cover (42). Therefore the internal guide tube (366) and the cylindrical block (368) are lifted, and an upper opening (374) of the quantity liquid pouring cylinder (356) and a lower opening (376) of that are closed by the cylindrical block (368) and the slide sleeve (354) respectively. The lifted cylindrical block (368) makes the stem (364) lift together with the slide sleeve (354), the internal guide tube (366) and the cylindrical block (368). At the time a spring receiver (380) of the stem (364) contacts the ceiling of the quantity liquid pouring cylinder (356) as shown in the dotted line of the drawing, the lift of the slide sleeve (354), the internal guide tube (366) and the cylindrical block (368) against the force of the depressed coil springs (362)(352) produces clearance between the nozzle tip (360) and the tip receiving seat mouth (358*b*) from which a fixed amount of liquid (β) contained in the quantity liquid pouring cylinder (356) from the tank (350) is filled up through the nozzle opening (42*a*). After the fixed amount filling up, the lifter (388) begins to go down and action of the depressed coil spring (352) makes the slide sleeve (354) go down. The tip receiving mouth (358) is closed by the nozzle tip (360). Following the lowering of the slide sleeve (354), the cylindrical block (368) and the internal guide tube (366) go down by the action of the depressed coil spring (362) and then return to the original position shown in the drawing. Through the opened opening (376), liquid (β) for the next filling up flows into the quantity liquid pouring cylinder (356) from the tank (350).

The filled up pouches (α) are discharged to the fourth conveyor (C4) together with the pouch supporting bases (A1) and through the turn-table (M) transferred to the fifth conveyor (C5). After passing the entrance adjusting conveyor apparatus (O), the pouch supporting bases (A1) enter into the line automatic distributing apparatus (K) where a single row is arranged into two rows and then move to the parallel exit adjusting conveyor apparatus (P1)(P2). The pouch supporting bases (A1) move ahead with the both sides thereof guided and regulated by the side guides (592) and during the lower part of the filling up mouth (α4) passing between the degassing guide bars (390)(392) of the pouch filling up mouth close apparatus (F1), air is let out of the filling up mouth (α4) by narrowing both sides of the mouth (α4). Going ahead further, the filling up mouth (α4) is gradually closed by a pair of the sandwiching stretch belts (396)(398) and perfectly closed. The closed filling up mouth (α4) is strained in the both end seam edges (α1)-(α2) by the difference in length of the terminal ends of the stretch belts (396)(398) to erase creases. Successively after delivery to the guidance belts (470)(472) of the pouch filling up mouth seal apparatus (F2), both sides of the closed filling up mouth (α4) are guided between the seal bands (434)(436). Going ahead still further with the ends of the filling up mouth (α4) sandwiched by the seal bands (434)(436), the filling up mouth (α4) takes the first and second heat seal operations by passing between the first heat seal bars (422)(424), and the second heat seal bars (426)(428). Successively, the filling up mouth (α4) which is fused with heat is cooled to stabilize and fix the seal. The filling up mouth (α4) which comes out from between the seal bands (434)(436) and which is still guided and regulated by the guidance belts (470)(472) is released from between the guidance belts (470)(472) after the hermetically sealed portion of the filling up mouth (α4) is marked with teeth of the knurling tool by passing the knurling tool tooth marking rolls (486)(488).

After the released filled up hermetical sealed pouches (α) together with the pouch supporting bases (A1) reach the terminal end of the sixth conveyor (C6), the seal portion of the filling up mouth (α4) is introduced into and sandwiched between lifting belts (570)(572) of the pouch removing apparatus (G) by mutual action of the permanent magnets (566)(568) and then move ahead. Entering the seventh conveyors (C7*a*)(C7*b*), the pouch supporting bases (A1) guided by the guide rail (564) gradually slide down. Therefore the hanging pouches (α) are separated from the pouch supporting bases (A1) and, at the terminal end of the seventh conveyors (C7*a*)(C7*b*), perfectly come out of the holding hole (36*c*) of the push-up plate (36) of the pouch supporting bases (A1). The pouch supporting bases (A1) are collected by the eighth conveyors (C8*a*)(C8*b*) and used repeatedly, while the filled up hermetically sealed pouch (α) are dropped onto the discharge conveyor (H) and fed to the next process.

In this way, the line (B) of this invention handles 240 pouches per minute in the filling up and sealing operation.

As the pouch supporting base (A1) of this invention, as described above, has the push-up plate (36) which contains and holds the pouch (α) and which contacts the filling up nozzle cover (42), the contact and push-up action of the filling up nozzle mechanism (40) is carried out without applying a load to the pouch (α). Therefore the way of filling up liquid at high speed by contacting the filling up nozzle mechanism (40) of the rotary high speed liquid filling up apparatus (E) is applied to soft material containers such as the pouches (α). Since the guiding projection portion (48)(50) prevent expansion of the lower part of the filled up pouch (α) occurring due to vibrations resulting from conveyance till the pouch supporting base collecting operation station (S4) separates the filled up pouches (α) from the pouch supporting bases (A1), there are no cases that the expanded lower part of the pouch (α) is caught by the holding hole (36*c*) and therefore, the expanded lower part of the pouch (α) is not separated from the holding hole (36*c*). This automatic pouch filling up seal line works effectively at high speed and had good reliability and high work efficiency.

Figure 19:
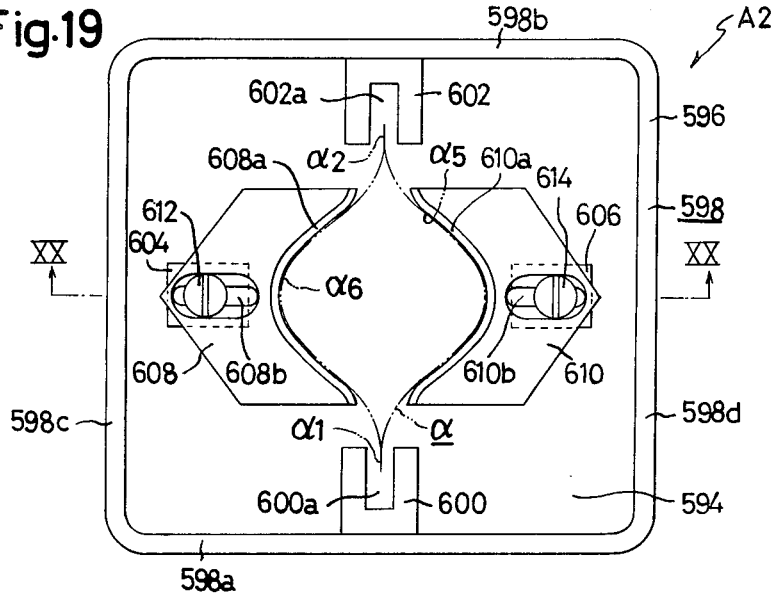
FIG. 19 is a plane view showing the secondary embodiment constructed in accordance with this invention.
Figure 20:
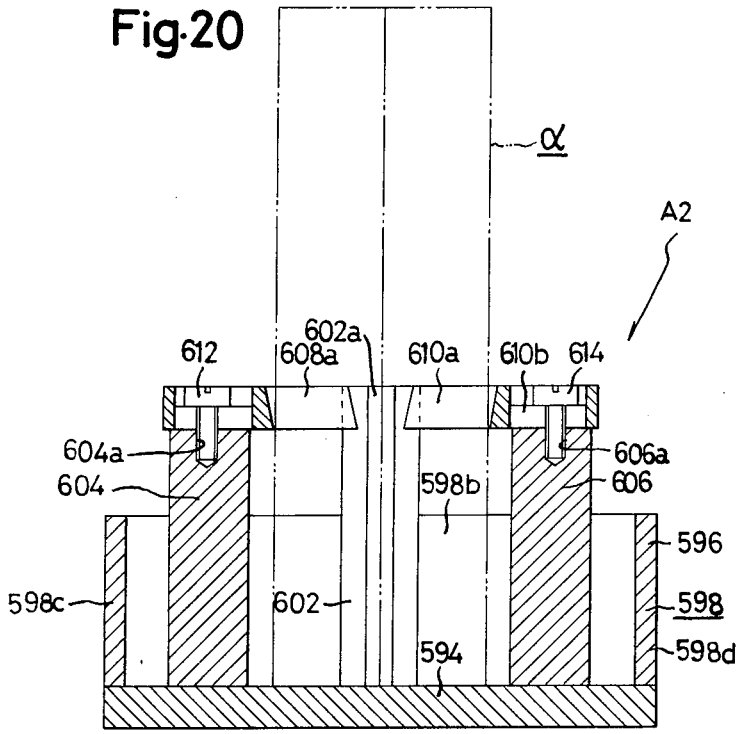
FIG. 20 is a sectional view taken substantially on line XX—XX of FIG. 19.
Figure 21:
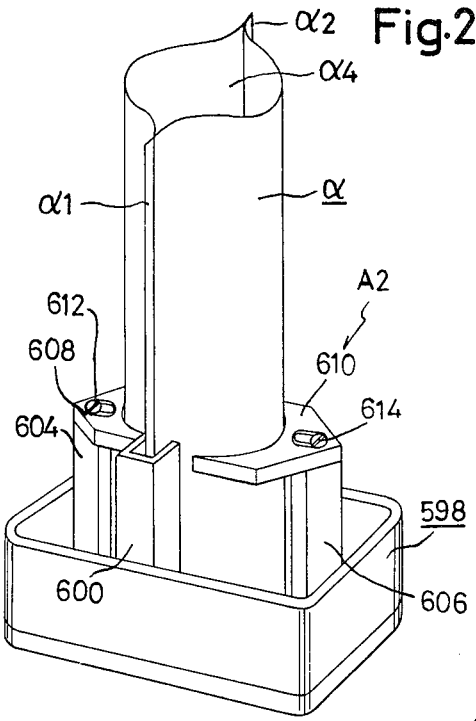
FIG. 21 is a perspective view showing that a pouch is held upright.

The second embodiment relating to the pouch supporting base of this invention will be explained with regard to FIGS. 19 to 21. The pouch supporting base (A2) of this invention is made of stainless steel, plastic, aluminum, iron, and various kinds of materials. A lower portion of the rear surface of a ⊐ -shaped sectional front and back pouch fixed member (600)(602) is attached to the middle of the inside surface of the front and back box wall (598*a*)(598*b*) of the base box (598) in the front and the back within the rectangular base box (598) consisting of a bottom base (594) and a box wall (596). The ⊐ -shaped sectional front and back pouch fixed members (600)(602) have opposite and facing grooves (600*a*)(602*a*) for insertion and holding both side seam portions (α1)(α2) of the expanded pouch (α). On the upper ends of the right and left supporting pillar members (604)(606) standing near to the center of the inside surfaces of the right and left box walls (598*c*)(598*d*) from the middle within the base box (598) are held the front and rear body surface (α5)(α6) of the expanded pouch (α) with well-maintained shape. The right and left body receiving pieces (608)(610) have opposite arcuate surfaces (608*a*)(610*a*) formed and on the inclined guide surface in which opposite surfaces symmetrically approach each other. Oblong holes (608*b*) (610*b*) bored in the right and left directions of the right and left body receiving pieces (608) (610) are fastened with screws (612) (614) sunk into internal screws (604*a*) (606*a*). Therefore the right and left body receiving pieces (608) (610) are set to freely adjust the right and left directions.

Figure 22:
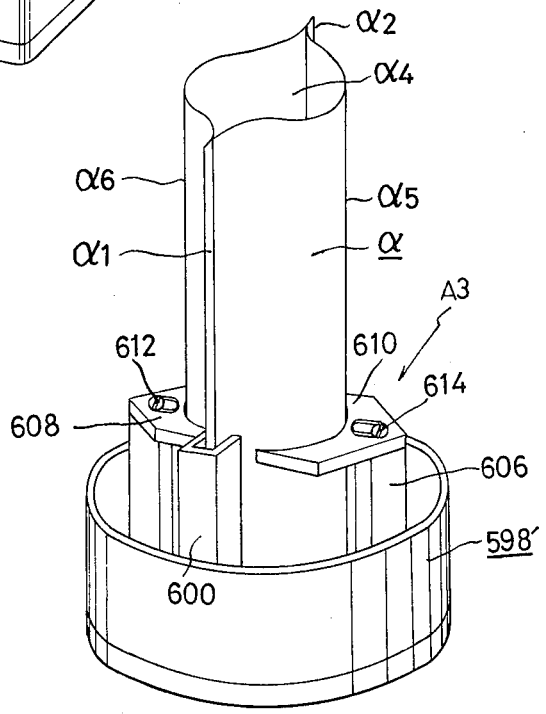
FIGS. 22 and 23 are perspective views showing modifications of the secondary embodiment of the pouch supporting base constructed in accordance with this invention.
Figure 23:
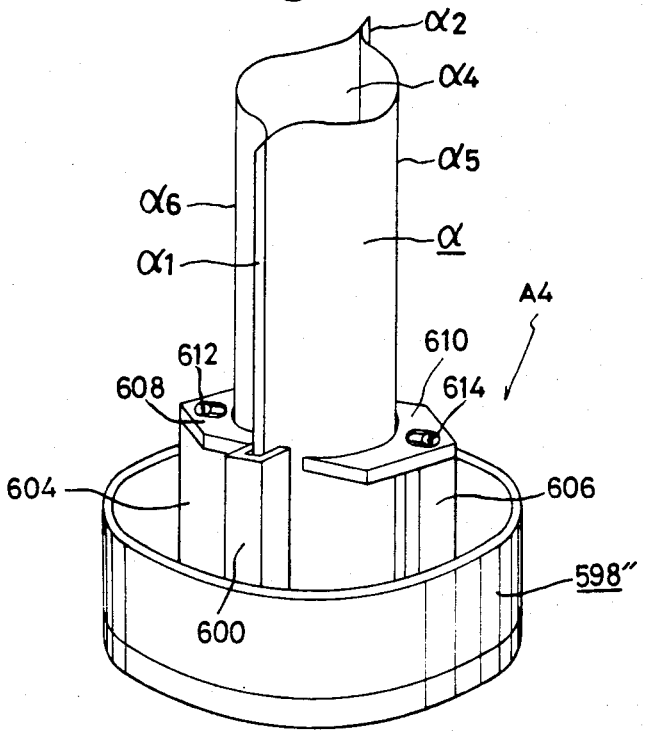

As far as the shape of the base box (598) in the second embodiment is concerned, the base box (598) may be, of, for example, a rectangle, or circular as shown in FIG. 22 showing an embodiment of the pouch supporting base (A3), an elliptical as in FIG. 23 showing an embodiment of the pouch supporting base (A4), square, polygon and so forth.

The pouch supporting bases (A2)(A3)(A4) of this invention, as will be apparent from above description about the structure, are possibly applied to the high speed automatic pouch filling up line (B) of this invention as with the pouch supporting base (A1) in the first embodiment.

The pouch supporting bases (A2) (A3) (A4), by following the first to eighth conveyors (C1)–(C8), pass the pouch dropping operation station (S1), the pouch filling up operation station (S2), the seal operation station (S3) and the pouch supporting base collecting station (S4) successively.

Figure 4:
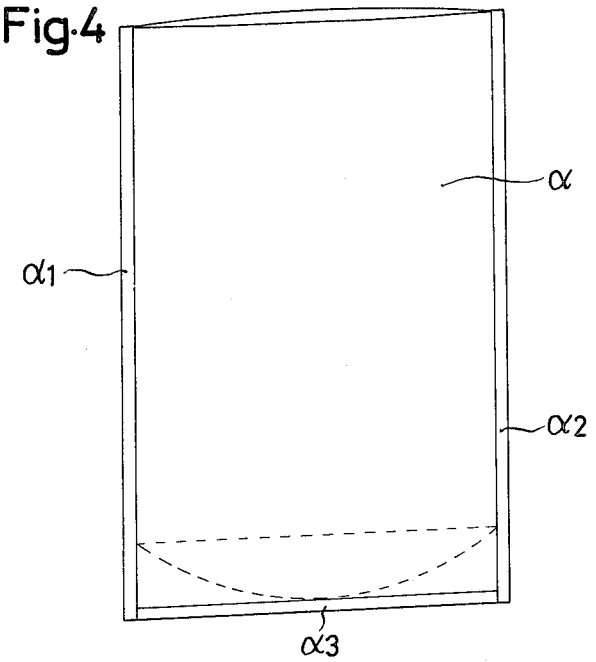
FIG. 4 is a flat folded pouch applied to this invention.
Figure 5:
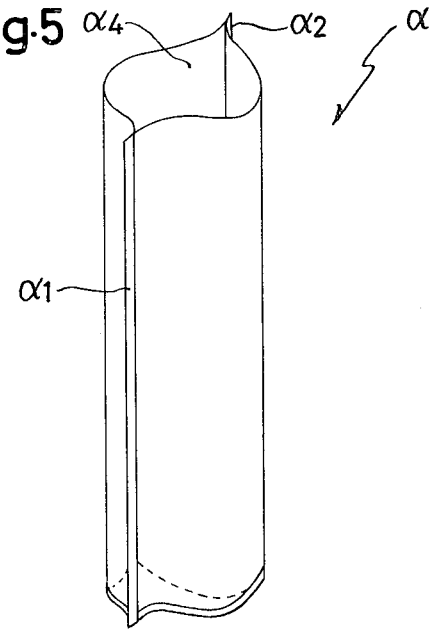
FIG. 5 is an opened and expanded pouch.

The folded flat pouch (α) shown in FIG. 4 is formed into the expanded pouch (α) shown in FIG. 5 by the pouch supplying and dropping operation system apparatus (D). When the pouch supporting bases (A2) (A3) (A4) pass the pouch dropping operation station (S1) by the conveyor (C1), the expanded pouch (α) is perpendicularly dropped into the pouch supporting bases (A2) (A3) (A4) from the apparatus (D). At this time, both side seam portions (α1) (α2) of the pouch (α) are inserted into the grooves (600*a*) (602*a*) of the pouch fixed members (600) (602) and the front and back body surfaces (α5)(α6) are guided and regulated by the opposite surfaces (608*a*) (610*a*) of the right and left body receiving pieces (608) (610). As a result, the pouch (α) is held upright as shown in FIGS. 21 to 23.

When the pouch supporting bases (A2) (A3) (A4) pass the filling up operation station (S2), substances are filled up in the pouch (α), by the rotary high speed liquid filling up apparatus (E), as soon as the lower end of the filling up nozzle cover (42) of the filling up nozzle apparatus (40) is pushed by the upper end of the pouch fixed members (600)(602) and/or the upper surface of the right and left body receiving pieces (608)(610). Successively, by the seal operation system apparatus (F) in the seal operation station (S2), the open mouth portion (α4) is sealed with heat. In the pouch supporting base collecting operation station (S4), by the pouch moving apparatus (G), the hermetically sealed filled up pouch (α) are separated from the pouch supporting bases (A2)-(A3)(A4) and then the empty pouch supporting bases (A2)(A3)(A4) are collected.

As mentioned above, since the pouches (α) held by the pouch supporting bases (A2)(A3)(A4) of this invention are possibly operated the same way as a bottle and a can container, as the hermetically filling up line for a bottle or a can container, a setting mechanism for the pouch (α) in opening and closing the pouch (α) and to the pouch supporting bases (A2)(A3)(A4) is set independently of the rotary high speed liquid filling up apparatus (E) and the seal operation system apparatus (F) and is possibly laid out with a consistent line connection. Therefore, the filling up speed is raised double or above compared with that of the conventional system. More particularly, in this invention, over 240 pouches are handled per minute.

Since the pouch (α) is set on the middle of the pouch supporting bases (A2)(A3)(A4) of this invention, the open mouth portion (α4) of the pouch (α) is easily and smoothly located on the center of any type of filling up nozzle. The rectangular or elliptical base boxes (598)(598″) of the pouch supporting bases (A2)(A4) possibly convey the pouch (α) in a fixed direction, and satisfy the demand to supply the pouch (α) to the seal operation system apparatus (F) with the prearranged supplying posture. Additionally, in the pouch supporting bases (A2)–(A4), different types of pouches (α) in size or capacity can be used, the right and left body receiving pieces (608) (610) slide along the oblong hole (608*b*) (610*b*) in the right and left direction after the screws (612)(614) are released, and thereby the position of the right and left body receiving pieces can be adjusted. Finally the screws (612)(614) are tightened.

What is claimed is:

1. Apparatus for automatically and continuously filling and sealing pouches with a filling material comprising a supplyfeeding means for feeding flat folded pouches one by one from a supply stack, expanding means for expanding said flat folded pouches which have been fed one by one to form open pouches, a pouch supporting base means for supporting said pouch in a generally upright position, a lowering means for lowering said open pouch onto said base means, a filler station means for supplying a filler substance to said open pouch, conveyor means for conveying said base means with said open pouch thereon to said filling station means, said base means having an engageable element, said filler station means having a filler nozzle operable to engage said engageable element to provide for filling of said pouch with said filler material via said filler nozzle, a closing and sealing station means operable to close and seal the open end of said filled pouch, second conveyor means for conveying said base means from said filling station to and through said closing and sealing station means, pouch removal means for removing said filled and sealed pouches from said base means, and third conveyor means for conveying said now empty base means to said lowering means for receiving another open pouch, thereby providing for continuously filling and sealing of said pouches.

2. Apparatus according to claim 1, wherein said pouch is made from a non-rigid material selected from the group consisting of paper, plastic, and aluminum foil and combinations thereof.

3. Apparatus according to claim 1 wherein said pouch has a closed end and an open end, said engageable element on said base means having an opening in which said open pouch is laterally supported at an intermediate position of said pouch between said closed end and said open end.

4. Apparatus according to claim 1, wherein said supplyfeeding means comprises roller means for feeding flat folded and generally horizontally disposed pouches in a generally horizontal direction from the bottom of said stack, and turn-over means receiving said horizontally fed pouches and turning said pouches to a generally vertically disposition with said open end being disposed at the top and said closed end being disposed at the bottom.

5. Apparatus according to claim 1, wherein said pouch has longitudinally extending seam edges, said turn-over means having guide groove-blade means for holding said seam edges, said expanding means further comprising vacuum cups for engaging said pouch and expanding and opening said pouch laterally as said seam edges are held by said guide groove-blade means.

6. Apparatus according to claim 5, wherein said lowering means comprises grip pusher means for sliding said pouch out of said guide-groove blade means, thereby lowering said open pouch into said opening of said engageable element of said base means, whereby the open pouch is supported in an upright disposition in said base means.

7. Apparatus according to claim 1, wherein said base means further comprises a base member for receiving the bottom end of said pouch, and elongated pillar elements extending from said said base member and supporting said engageable element above said base member.

8. Apparatus according to claim 7, wherein said pouch has longitudinally extending side seams, said engageable element having grooves for accommodating said side seams, said base member having projecting portions for supporting the bottom end portion of said pouch.

9. Apparatus according to claim 5, wherein said expanding means further comprises air nozzle means for blowing air into said pouch to effect opening of said pouch.

10. Apparatus according to claim 4, wherein said pouch has side seams, said turn-over means comprising a rotary wheel having a plurality of radially disposed guide-groove blade means for holding said side means, said guide-groove blade means being operable to receive a horizontally disposed pouch from said supplyfeeding means and rotate said pouch 270 degrees to said generally upright disposition.

11. Apparatus according to claim 10, wherein four of said guide-groove blade means are provided on said rotary wheel.

12. Apparatus according to claim 10, wherein said turn-over means further comprises cam elements to operate said guide-groove blade means to effect holding and release of said side seams of said pouch.

13. Apparatus according to claim 1, wherein said filler station means comprises a tank for said filler material, filler material passage means for filler material to pass from said tank to said filler nozzle, said filler nozzle having a nozzle mouth movable into a position disposed within the open end of said pouch, and a nozzle cover disposed about said nozzle mouth, said nozzle cover being movable to a position to engage said engageable element of said base means to initiate flow of filler material into said pouch.

14. Apparatus according to claim 13, wherein said nozzle mouth is movable into a position to engage the open end of said pouch when said nozzle cover engages said engageable element to initiate flow of said filler material.

15. Apparatus according to claim 13, wherein said filler material passage means comprises a valve for controlling flow of filler material from said tank to said filler nozzle and spring means biasing said valve in a closed position, said valve being opened by engagement of said nozzle cover with said engageable element.

16. Apparatus according to claim 13, wherein said filler nozzle is disposed with its axis extending vertically, said nozzle cover extending below the lower end of said nozzle mouth.

17. Apparatus according to claim 1, wherein said closing and sealing station means comprises a pair of air-removing guide means operable to remove air from the open end of said pouch prior to sealing of said pouch, said pair of air-removing guides being parallel to each other, a pair of endless belts which are spaced from one another with a graudally decreasing space, said open end of said pouch passing through said gradually decreasing space to gradually close the open end of said pouch, and a sealing device operable to seal said closed pouch.

18. Apparatus according to claim 17, wherein said sealing device comprises at least one pair of seal bars and a pair of endless sealing bands.

19. Apparatus according to claim 1, wherein said filler station means comprises a rotary wheel to convey said base means through a rotary path during filling of said pouches.

20. Apparatus according to claim 19, wherein said first conveyor means comprises a first pair of conveyor devices conveying a double row of base means, said first conveyor means further comprising a converger means for converging said double row into a single row, said first conveyor means further comprising a first single row conveyor device for conveying said single row of base means from said converger means to said filler station means.

21. Apparatus according to claim 20, wherein said second conveyor means comprises a second single row conveyor device for conveying a single row of base means from said filler station means, said second conveyor means further comprising a channelizer means for channeling said single row of base means into a double row, said second conveyor means further comprising a second pair of conveyor devices for conveying said double row of base means from said channelizer means to and through said closing and sealing station means.

22. Apparatus according to claim 21, wherein said third conveyor means comprises a third pair of conveyor devices for conveying said double row of empty base means from said second pair of conveyor devices to said first pair of conveyor devices.

23. Apparatus according to claim 22, wherein said pouch removal means comprises a pair of lifting belts having opposed magnets between which said pouch passes, whereby the pouches are grasped between said opposed magnets and separated from said base means.

24. Apparatus according to claim 23, wherein said pair of lifting belts are generally horizontally disposed, said third conveyor means comprising an inclined conveyor device which conveys said base means to a lower elevation as said pouches are grasped by said magnets such that said base means are thereby withdrawn downwardly from said pouches as the latter are grasped by said magnets and conveyed generally horizontally by said pair of lifting belts.

25. Apparatus according to claim 1, wherein said base means comprises a base box, a pair of pillar support members extending upwardly from said base box, and receiving elements mounted on said support members and having arcuate portions engageable with the sides of said pouch to preclude lateral expansion of said pouch beyond said receiving elements.

26. Apparatus according to claim 25 further comprising adjusting means for adjustably mounting said receiving elements on said pillar supports to thereby provide an adjustment for the lateral dimension of said pouch within said base means.

27. Apparatus according to claim 26, wherein said base means further comprises elongated upright members having grooves for receiving side seams on said pouches.

28. A method for automatically and continuously filling and sealing pouches, comprising supplying a stack of flat folded pouches, feeding said flat folded pouches one by one from said stack, expanding said flat folded pouches which have been fed one by one to form open pouches, lowering said open pouch into a pouch receiving opening in a pouch supporting base, means at a pouch receiving station, supporting said open pouch in said base means in a generally upright position with the upper end of the pouch being open, conveying said base means with said open pouch therein to a filling station, placing a nozzle means at said upper open end of said pouch, engaging said nozzle means with said base means to provide for flow of filler material from said nozzle means into said open pouch to thereby fill said pouch with said filler material, conveying said base means with said filled-up pouch thereon to a closing and sealing station, closing and sealing the open upper end of said pouch at said closing and sealing station, conveying said sealed pouch from said sealing station, removing said filled and sealed pouch from said base means, and returning said base means which is now empty to said pouch receiving station to receive another open pouch, and repeating the above steps continuously to thereby provide for continuous and sutomatic filling and sealing of said pouches.

29. A method according to claim 28, wherein said pouch is made of a non-rigid material selected from the group consisting of paper, plastic and aluminum foil and combinations thereof.

30. A method according to claim 28 comprising conveying said base means continuously and repeatedly over a closed loop path of travel.

31. A method according to claim 28 further comprising conveying a double row of base means through said pouch receiving station, converging said double row to a single row, conveying said single row to and from said filling station, channeling said single row from said filling station to a double row, and conveying the last said double row through said closing and sealing station and back to said pouch receiving station.

32. A method according to claim 28, wherein said step of closing and sealing comprises passing said pouch between parallel air-removal guide bars for removing air from said pouches prior to sealing of said pouches, passing the upper portion of said pouch between a pair of endless belts which are spaced from one another with a gradually decreasing space to thereby gradually close the open end of said pouch, and subsequently sealing said closed pouch.

33. A method according to claim 28, wherein said step of removing said pouches from said base means comprises grasping the upper sealed ends of said pouches and moving said grasped pouches generally horizontally while simultaneously conveying said base means to a lower elevation to thereby withdrawn said base means from said pouches.

34. A method according to claim 28, wherein said step of feeding said flat folded pouches and expanding said flat folded pouches comprises grasping said side seams of said pouch, and utilizing vacuum to grasp the sides of said pouch to expand the latter.

35. A method according to claim 28, wherein said step of feeding said flat folded pouches comprises initially conveying said pouches in a generally horizontal direction and turning said pouches to a generally upright position, said lowering step comprising lowering said upright pouch onto said base means.

36. A method according to claim 35, wherein said turning of said pouch comprises turning said pouch through a 270 degree arc.

37. A method according to claim 28, wherein said pouch has a closed end and an open end, and further comprising laterally supporting said open pouch at an intermediate position of said pouch between said closed end and said open end.

38. A method according to claim 37, wherein said step of feeding said flat folded pouches comprises feeding said flat folded pouches in a generally horizontal direction from the bottom of a generally vertical stack, and turning said pouches to a generally vertical disposition with said open end being disposed at the top and said closed end being disposed at the bottom.

39. A method according to claim 38, wherein said pouch has longitudinally extending seam edges, and further comprising holding said seam edges during said turning step, said expanding step comprising engaging said pouch with vacuum cups and expanding and opening said pouch laterally while holding said seam edges.

40. A method according to claim 37, wherein said lowering step comprises sliding said pouch downwardly into an opening in said base means, and supporting said open pouch is in an upright disposition in said base means.

41. A method according to claim 39, wherein said expanding step further comprises blowing air into said pouch to effect opening of said pouch.

42. A method according to claim 28, wherein said nozzle means comprises a nozzle cover, and moving said nozzle cover to a position to engage an engageable element of said base means to initiate flow of filler material into said pouch.

43. A method according to claim 42, wherein said nozzle means has a nozzle mouth, further comprising moving said nozzle mouth into a position to engage the open end of said pouch when said nozzle cover engages said engageable element to initiate flow of said filler material.

44. A method according to claim 28, wherein said closing and sealing step comprises removing air from the open end of said pouch prior to sealing of said pouch, passing said open end of said pouch between a pair of endless belts which are spaced from one another with a gradually decreasing space, gradually closing said open end of said pouch as the latter passes through said gradually decreasing space to thereby close the open end of said pouch, and subsequently sealing said closed pouch.

45. A method according to claim 28, further comprising conveying said base means through a rotary path having a vertical axis during filling of said pouches.

46. A method according to claim 28, wherein said pouch removing step comprises passing said pouches between a pair of lifting belts having opposed magnets, and grasping said pouches with said opposed magnets and thereby separating said pouches from said base means.

47. A method according to claim 46, wherein said pair of lifting belts are generally horizontally disposed, and further comprising conveying said base means to a lower elevation than said lifting belts as said pouches are grasped by said magnets, and withdrawing said base means downwardly from said pouches as the latter are grasped by said magnets and conveyed generally horizontally by said pair of lifting belts.

* * * * *